US009753434B2

(12) United States Patent
Kobayashi

(10) Patent No.: US 9,753,434 B2
(45) Date of Patent: Sep. 5, 2017

(54) WATCH

(71) Applicant: Citizen Watch Co., Ltd., Nishitokyo-shi, Tokyo (JP)

(72) Inventor: Michiyuki Kobayashi, Tokyo (JP)

(73) Assignee: CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 14/893,540

(22) PCT Filed: Jun. 19, 2014

(86) PCT No.: PCT/JP2014/066302
§ 371 (c)(1),
(2) Date: Nov. 24, 2015

(87) PCT Pub. No.: WO2014/203973
PCT Pub. Date: Dec. 24, 2014

(65) Prior Publication Data

US 2016/0109853 A1 Apr. 21, 2016

(30) Foreign Application Priority Data

Jun. 20, 2013 (JP) ..... 2013-129610

(51) Int. Cl.
*G04B 19/18* (2006.01)
*G04B 19/22* (2006.01)
*G04B 19/28* (2006.01)

(52) U.S. Cl.
CPC ..... *G04B 19/286* (2013.01); *G04B 19/18* (2013.01); *G04B 19/22* (2013.01); *G04B 19/223* (2013.01); *G04B 19/225* (2013.01)

(58) Field of Classification Search
CPC ..... G04B 19/18; G04B 19/22; G04B 19/223; G04B 19/225; G04B 19/286
(Continued)

(56) References Cited

U.S. PATENT DOCUMENTS 4,420,264 A * 12/1983 Murata ..... G04B 19/283 116/279
6,200,019 B1 * 3/2001 Latini ..... G04B 19/283 368/288
(Continued)

FOREIGN PATENT DOCUMENTS

CH WO 2012176058 A1 * 12/2012 ..... G04B 47/046
CN 2098702 U 3/1992
(Continued)

OTHER PUBLICATIONS

International Search Report PCT/ISA/210 for International Application No. PCT/JP2014/066302 dated Aug. 8, 2014.
(Continued)

*Primary Examiner* — Amy Cohen Johnson
*Assistant Examiner* — Daniel Wicklund
(74) *Attorney, Agent, or Firm* — Harness, Dickey & Pierce, P.L.C.

(57) ABSTRACT

Facilitate operations to release a bezel from a rotation prevented state and to rotate the bezel and avoid erroneously releasing the rotation prevented state. A timepiece includes a restrictor having engaging teeth and being movable between a restricted position and a release position by engaging/disengaging the engaging teeth with teeth of the bezel. The timepiece also has a holding mechanism holding the restrictor between a held state, i.e., restricted position and a non-held state. i.e., the release position. The holding mechanism includes two push-buttons and a release mechanism including a spring bar and engaging hole. The release mechanism switches the restrictor to the non-held state irrespective of a continuance of applying the pressing operation forces after the pressing operation forces are applied simultaneously to the two push-buttons.

12 Claims, 24 Drawing Sheets

(58) Field of Classification Search
USPC ..... 368/294, 295
See application file for complete search history.

(56) References Cited

U.S. PATENT DOCUMENTS

| | | | | |
|---|---|---|---|---|
| 8,235,587 | B2 * | 8/2012 | Hiranuma | G04B 3/043 368/295 |
| 8,491,162 | B2 * | 7/2013 | Lee | F21V 29/004 313/46 |
| 9,285,776 | B1 * | 3/2016 | Custer | G04B 37/22 |
| 9,360,841 | B1 * | 6/2016 | Tolani | G04B 3/045 |
| 2003/0123332 | A1 * | 7/2003 | Hiranuma | G04B 19/283 368/295 |
| 2007/0253290 | A1 * | 11/2007 | Aire | G04B 3/045 368/294 |
| 2008/0117723 | A1 | 5/2008 | Hiranuma et al. | |
| 2008/0285391 | A1 | 11/2008 | Hiranuma | |
| 2010/0220560 | A1 | 9/2010 | Hiranuma et al. | |

FOREIGN PATENT DOCUMENTS

| | | | |
|---|---|---|---|
| FR | 1603938 | A | 6/1971 |
| JP | 2008-128880 | A | 6/2008 |
| JP | 2008-275532 | A | 11/2008 |
| JP | 2010-185833 | A | 8/2010 |

OTHER PUBLICATIONS

Office Action for Corresponding Chinese Patent Application No. 201480034195.X issued on Mar. 16, 2017.

* cited by examiner

SECT.A-A

SECT.B-B

WATCH

CROSS-REFERENCE TO RELATED APPLICATION

The present application is based on and claims priority to Japanese patent application No. 2013-129610, filed on Jun. 20, 2013, the disclosure of which is hereby incorporated by reference herein in its entirety.

The present invention relates to a timepiece, in particular, to improvement in a rotatable bezel.

BACKGROUND ART

A rotatable bezel is provided in the case of a so-called diver's watch, aiming for allowing users to easily know how much time is left for diving or other purposes. The bezel is rotatable to a certain position and then maintains the position. However, the bezel may be easily moved from the position when hit by an obstacle, for example.

To prevent such an unintentional motion of the bezel, a rotation preventing (lock) mechanism has been proposed for allowing the bezel to rotate by rotational operation and restricting the rotation of the bezel in non-rotational operation (see Japanese Laid-Open Patent Applications No. 2008-128880 and No. 2010-185833). According to this mechanism, a lock element is generally engaged with the bezel to limit the rotation of the bezel when the bezel is not operated. On the other hand, the lock element and the bezel are disengaged from each other by pressing a push-button or an unlock button to allow the bezel to rotate when the bezel is operated.

SUMMARY

However, the mechanism disclosed in Patent Literature 1 requires a user to continuously press the push-button for rotating the bezel since the bezel is allowed to rotate only while the push-button is being pressed. That is, it is difficult to manipulate the bezel to rotate with a single hand while pressing the push-button.

Further, in diving environment in which a diver's watch is used, a user wears gloves. Therefore, it is also difficult for the user to perform the two operations as above at the same time with the gloved hands. Moreover, the push-button may be unexpectedly being pressed by another element, which causes the bezel to become rotatable and erroneously rotated.

Meanwhile, Patent Literature 2 teaches that the bezel is allowed to rotate only while two unlock buttons are being concurrently pressed. Accordingly, erroneously unlocking the buttons is unlikely to occur, unlike Patent Literature 1 using only one unlock button. However, similar to Patent Literature 1, a user is required to continuously press the two unlock buttons with a single hand, which is a difficult manipulation. Note that this problem is not specific to a diver's watch. It may occur in any timepiece including a rotatable bezel.

In view of the above problem, the present invention aims to provide a timepiece which can easily rotate a bezel and release the bezel from a rotation prevented state as well as can prevent or inhibit erroneous release of the bezel from the rotation prevented state.

A timepiece according to the present invention includes a restrictor which prevents the bezel from rotating and a holding mechanism which holds the restrictor in a restricted position in which the bezel is prevented from rotating. When pressing operation forces are applied to two operation input units of the holding mechanism, a release mechanism of the holding mechanism moves the restrictor from the restricted position to a release position even if the pressing operation force are discontinued. This eliminates the necessity for simultaneously performing two operations, i.e, rotation-prevention releasing operation and bezel rotational operation, leading to facilitating the two operations. Unless the operation input units receive the pressing force concurrently, the restrictor is held in the restricted position. Thereby, the rotation prevented state of the bezel is prevented or inhibited from being erroneously cancelled.

The timepiece according to the present invention includes a case containing a movement of a timepiece, a bezel rotatably provided in the case, including an engaged portion, a restrictor including an engaging portion which prevents the bezel from rotating when engaged with the engaged portion and allows the bezel to rotate when not engaged with the engaged portion, the restrictor movable between a restricted position in which the engaging portion is engaged with the engaged portion and a release position in which the engaging portion is not engaged with the engaged portion, and a holding mechanism which switchably holds the restrictor between a held state and a non-held state, the held state in which the restrictor is held in the restricted position, the no-held state in which the restrictor is moved to the release position, wherein the holding mechanism includes two operation input units to which independent pressing operation forces are respectively applied, and a release mechanism which switches the restrictor from the held state to the non-held state irrespective of a continuance of the pressing forces after the pressing operation forces are concurrently applied.

DESCRIPTION OF EMBODIMENTS

Hereinafter, embodiments of the present invention will be described with reference to the accompanying drawings.

Figure 1:
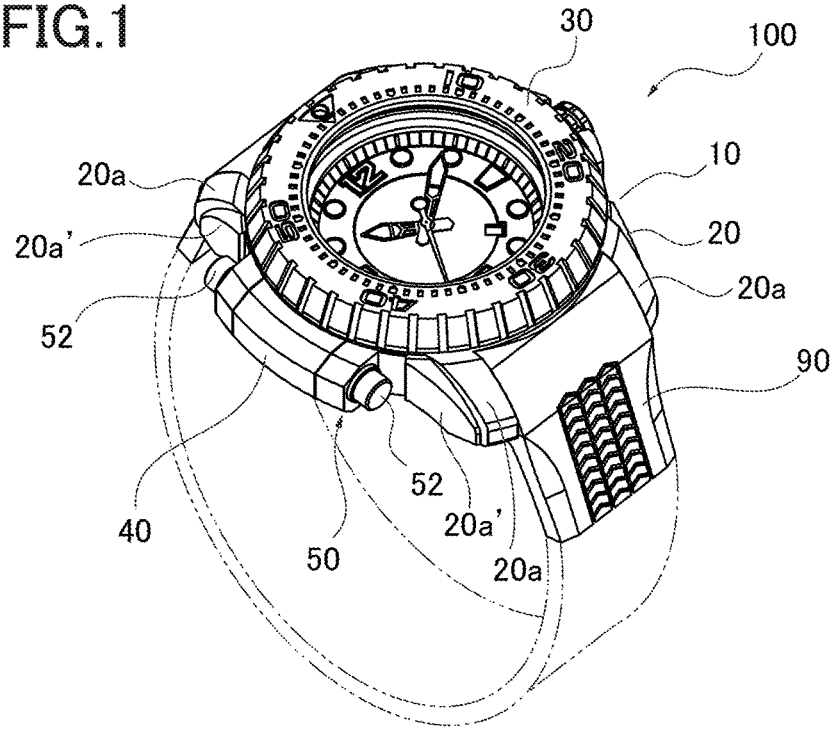
FIG. 1 is a schematic perspective view of a wristwatch according to one embodiment of the present invention.

A wristwatch 100 (hereinafter, timepiece 100) shown in FIG. 1 is a diver's watch according to an embodiment of a timepiece according to the present invention. A band 90 is provided in a body 10 of the timepiece 100 in a direction connecting 12 o'clock and 6 o'clock on a clock face. A user put his or her arm into the band in a direction connecting 9 o'clock and 3 o'clock on the clock face.

A case (case member) 20 of the body 10 contains a timepiece movement and is equipped with, on a top face, a bezel 30 rotatable counterclockwise by a user's manipulation with his/her fingers. The case 20 may or may not include a not-shown rear cover.

Figure 2:
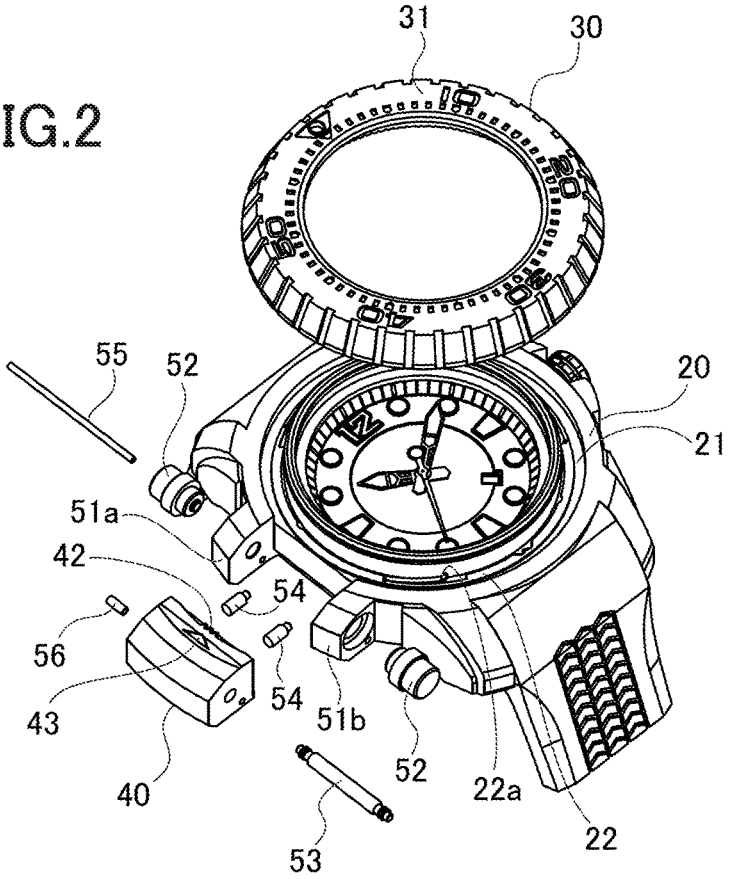
FIG. 2 is an exploded perspective view of the wristwatch in FIG. 1.

As shown in FIG. 2, numerals and scales are provided on a top face 31 of the bezel 30 to show remaining time and the like depending on a positional relationship with a minute hand of the body 10.

Figure 3A:
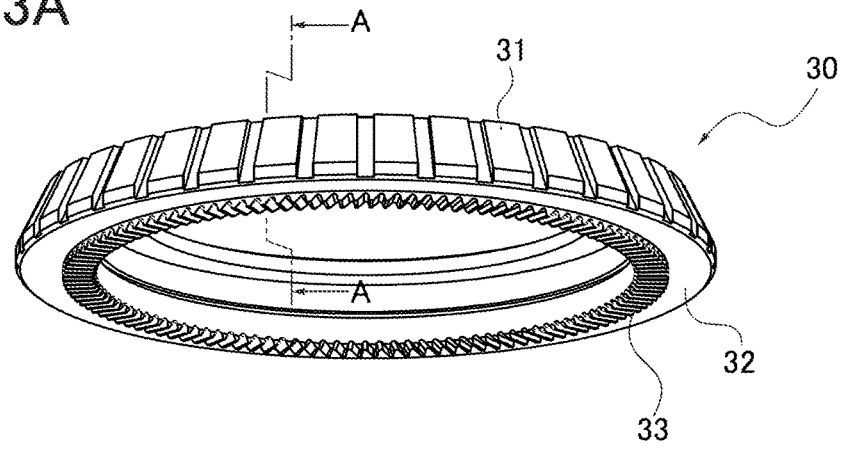
FIG. 3A is a perspective view of a bezel as seen from below.

Meanwhile, teeth 33 (engaged portion) are formed on the bottom face 32 of the bezel 30. The teeth 33 are protrusions and depressions arranged in a circumferential direction, as shown in FIG. 3A. The protrusions 33*a* and the depressions 33*b* (see FIGS. 10A, 10B, 10C) of the teeth 33 radially extend from the center of the bezel 30 respectively.

Figure 3B:
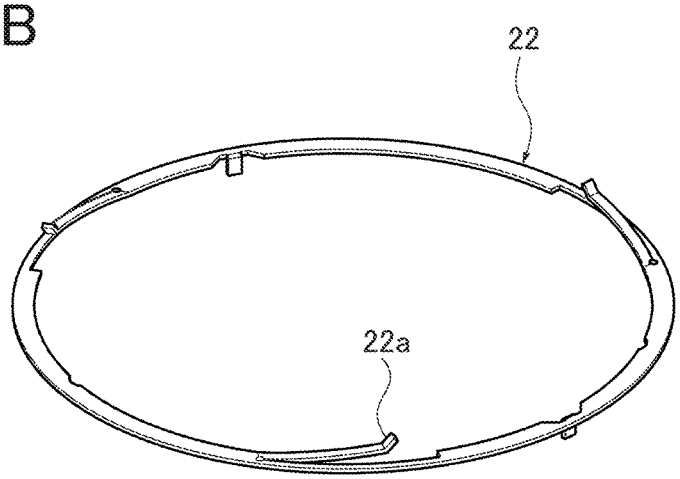
FIG. 3B is a perspective view of a ring.
Figure 4:
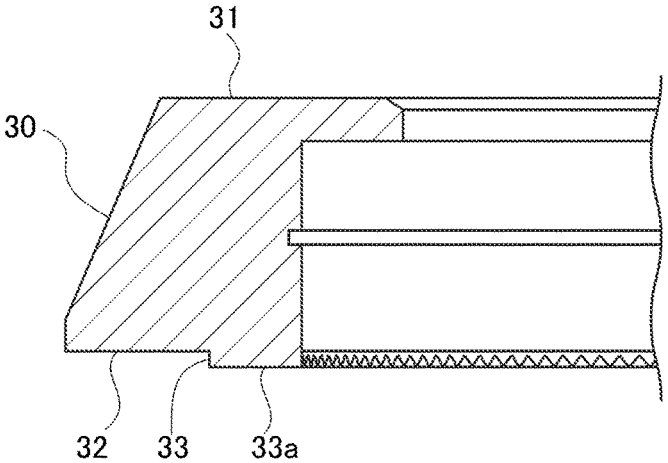
FIG. 4 is a cross section view of the ring along an A to A line in FIG. 3A.

When the bezel 30 is attached to the case 20, the teeth 33 function to prevent the bezel 30 from rotating clockwise by engaging with an elastic pin 22*a* of a ring 22 placed in a ring groove 21 of the case 20, as shown in FIG. 3B. The teeth 33 also function to the bezel 30 to rotate counterclockwise by elastic deformation of the elastic pin 22*a*. Each time the elastic pin 22*a* is passed over by one of the protrusions 33*a* of the teeth 33, a user feels clicking. The teeth 33 hold and stop the bezel 30 when the elastic pin 22*a* is fitted into one of the depressions 33*b* between any two adjacent protrusions 33*a*. As shown in FIG. 4, the protrusions 33*a* of the teeth 33 protrude more downward than the bottom face 32 of the bezel 30.

A restrictor 40 and a holding mechanism 50 are provided on the 9 o'clock side of the clock face of the case 20. Here, the restrictor 40 and the holding mechanism 50 are made from resin or metal (such as stainless steel and titanium).

Figure 5:
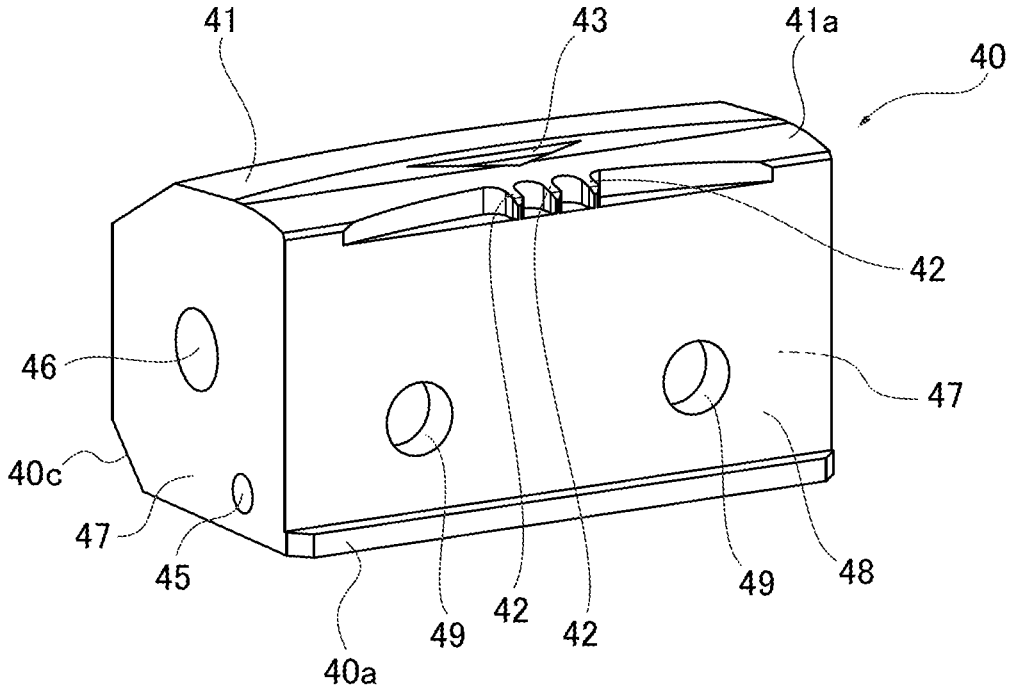
FIG. 5 is a view showing a restrictor in detail.

As shown in FIG. 5, the restrictor 40 includes, on a top face 41, three engaging teeth 42 (engaging portion, convexes) which function to prevent the bezel 30 attached to the case 20 from rotating when engaged with the teeth 33 of the bezel 30 and to allow the bezel 30 to rotate when not engaged with the teeth 33. Note that the engaging teeth 42 are engaged with the depressions 33*b* of the teeth of the bezel 30, and concaves between the engaging teeth 42 are engaged with the protrusions 33*a* of the teeth of the bezel 30. Alternatively, the engagement can be one of the two above.

Figure 6A:
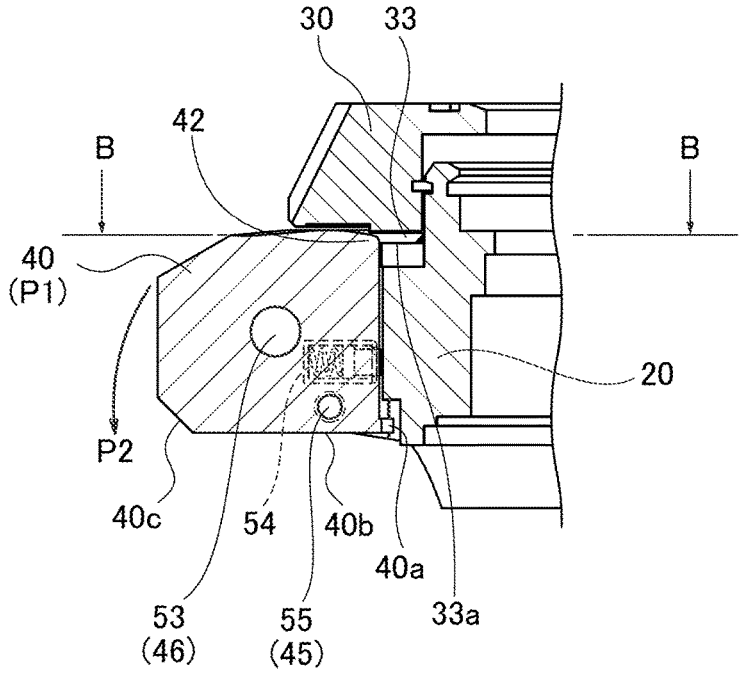
FIG. 6A is a cross section view of the restrictor in a restricted position when the center of the wristwatch and the restrictor are vertically sectioned.
Figure 6B:
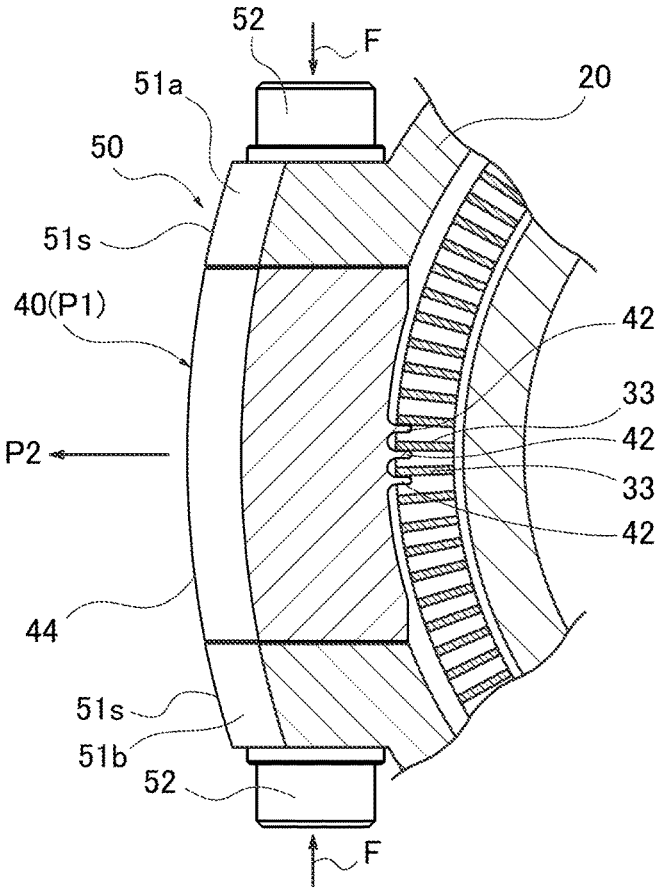
FIG. 6B is a cross section view of the restrictor in the restricted position along with a B to B line in FIG. 6A.
Figure 7A:
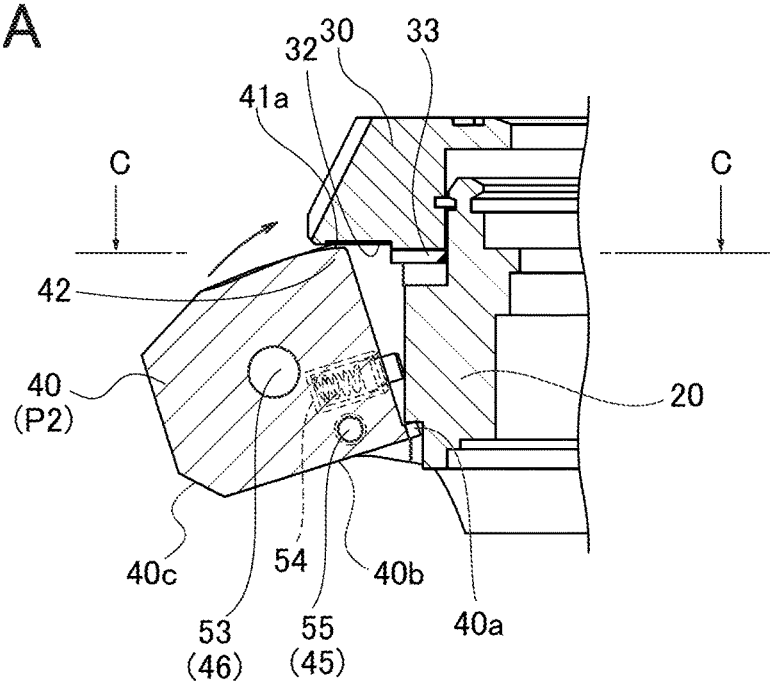
FIG. 7A is a cross section view of the restrictor in a release position when the center of the wristwatch and the restrictor are vertically sectioned.
Figure 7B:
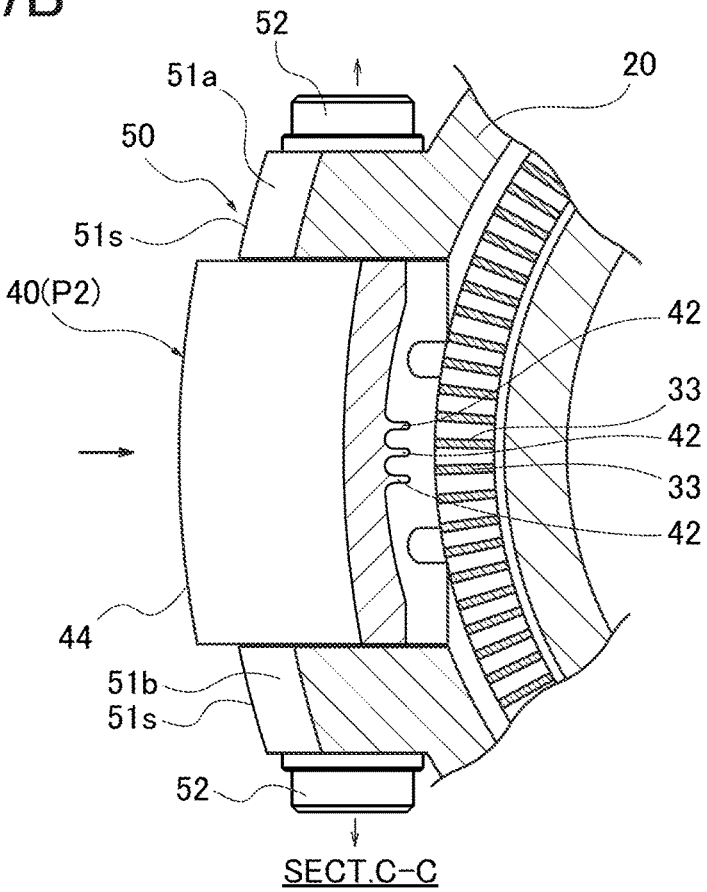
FIG. 7B is a cross section view of the restrictor in the release position along with a C to C line in FIG. 7A.

The restrictor 40 is rotatably provided around a shaft 55 inserted into a shaft hole 45 between a restricted position P1 in which the engaging teeth 42 are engaged with the teeth 33 of the bezel 30 as shown in FIGS. 6A, 6B and a release position P2 in which the engaging teeth 42 are disengaged from the teeth 33 of the bezel 30 as shown in FIGS. 7A and 7B.

The restrictor 40 includes a rotation restrictor 40*a*. The rotation restrictor 40*a* abuts on the case 20 to limit a rotational range of the restrictor 40 to stop at a certain rotational position when the restrictor 40 is in the release position as shown in FIGS. 7A, 7B.

Figure 8A:
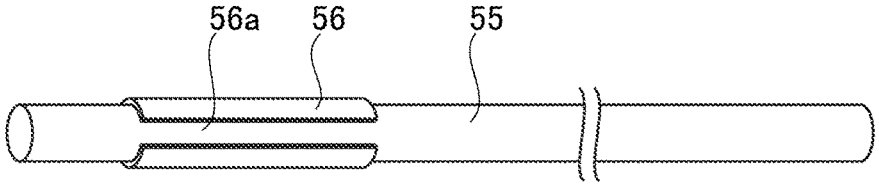
FIG. 8A is a perspective view of a shaft and a sleeve.
Figure 8B:
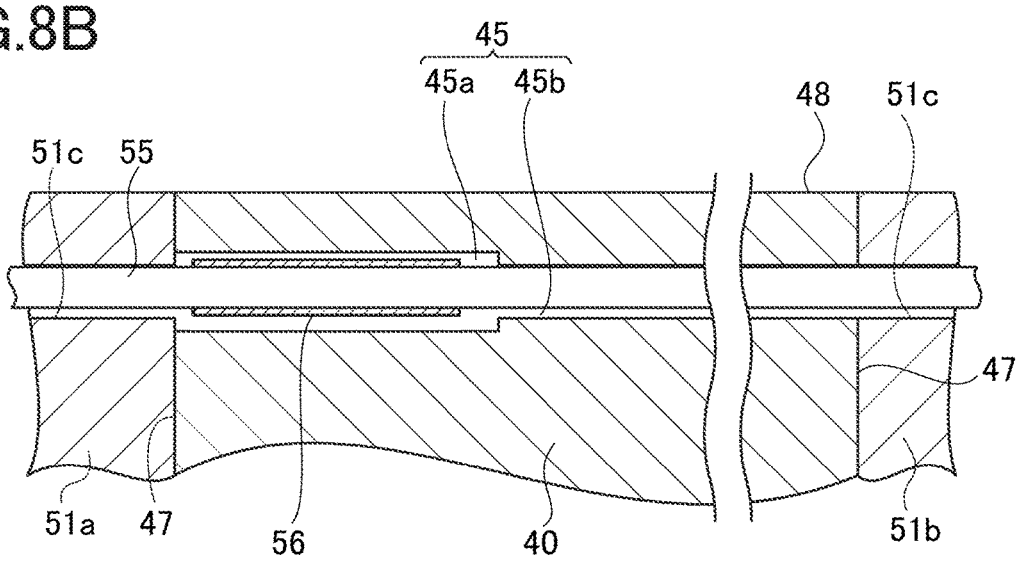
FIG. 8B is a vertical cross section view of the shaft and the sleeve inserted into a through hole.

As shown in FIG. 8A, a sleeve 56 is pressed into the outer circumference of the shaft 55. The sleeve 56 with a C-shape cross section includes a slit 56*a* (corresponding to a C-shape cutout) axially extending on a part of the circumferential wall of the shaft 55. As shown in FIG. 8B, a small diameter portion 45*b* and a large diameter portion 45*a* are formed in the shaft hole 45. The small diameter portion 45*b* is larger than the shaft 55 and smaller than the sleeve 56 in outer diameter. The large diameter portion 45*a* is larger than the sleeve 56 in outer diameter.

Before the insertion of the shaft 55, the slit 56*a* of the sleeve 56 is formed to have a narrower width, therefore, the outer diameter of the sleeve 56 is smaller than after the insertion of the shaft 55 and larger than the small diameter portion 45*b*. Further, the diameters of holes 51*c*, 51*c* of legs 51*a*, 51*b* (engaging members) are smaller than the outer diameter of the sleeve 56 with the shaft 55.

Before the insertion of the shaft 55, the sleeve 56 is preset in the large diameter portion 45*a*. Then, the shaft 55 is inserted into the holes 51*c*, 51*c* of the legs 51*a*, 51*b*, the shaft hole 45 of the restrictor 40, and into the sleeve 56, widening the width of the slit 56*a*.

Thus, the outer diameter of the sleeve 56 into which the shaft 55 is inserted is larger than that of the hole 51*c* of the leg 51*a* adjacent to the sleeve 56 and that of the small diameter portion 45*b* of the restrictor 40. This prevents the sleeve 56 from dropping off from the large diameter portion 45*a*. The shaft 55 is pressed into and integrated with the sleeve 56. The shaft 55 can be thus prevented from dropping off from the shaft hole 45.

Figure 9:
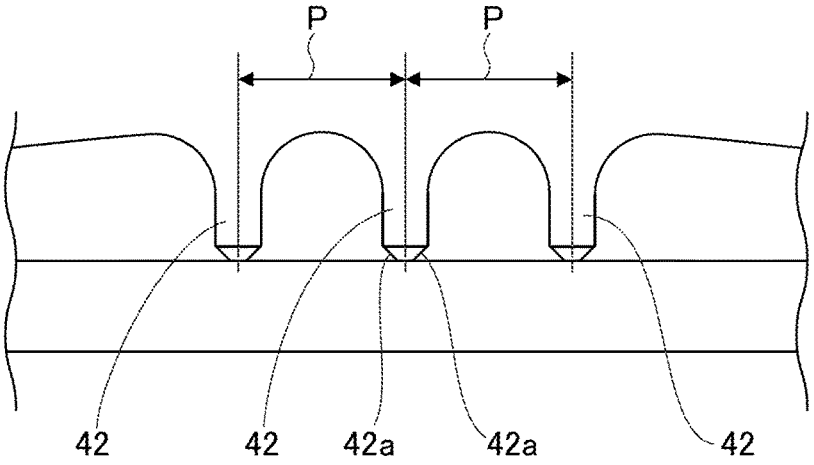
FIG. 9 is a plan view of detailed engaging teeth.
Figure 10A:
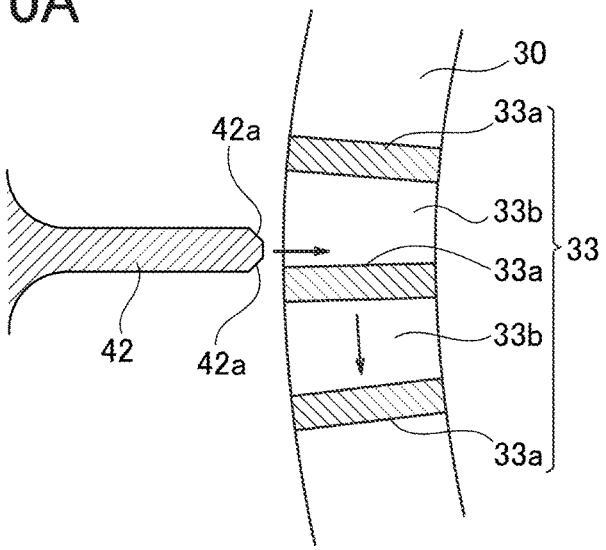
FIG. 10A is a view showing a process of engagement between the engaging teeth of the restrictor and teeth of the bezel before the engagement.

As shown in FIG. 9, the pitch P between two adjacent teeth 42 of the three engaging teeth 42 approximately matches the pitch between the teeth 33 on the outer circumferential edge of the bezel 30. A tip end of each of the engaging teeth 42 forms tapers 42*a*, 42*a* each of which has a narrower end in the direction in which the three engaging teeth 42 are arranged. By the narrow-width tapers 42*a*, 42*a* at the ends, the engaging teeth 42 can easily approach and enter into the depressions 33*b* of the teeth 33 while the engaging teeth 42 are being close to the teeth 33 from the state (shown in FIG. 10A) in which the engaging teeth 42 are disengaged with the teeth 33 of the bezel 30, as shown in FIGS. 10A-10C.

Figure 10B:
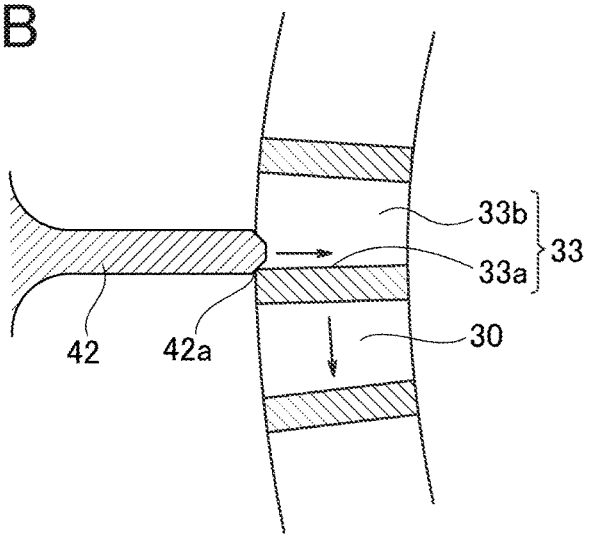
FIG. 10B is a view showing a process of the engagement between the engaging teeth of the restrictor and teeth of the bezel when the engagement starts.
Figure 10C:
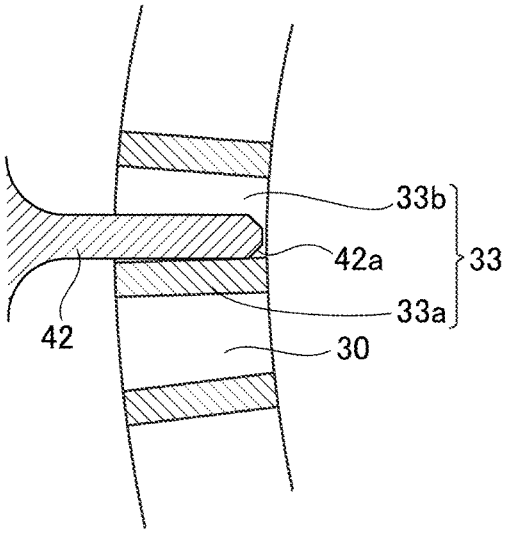
FIG. 10C is a view showing a process of the engagement between the engaging teeth of the restrictor and teeth of the bezel when the engagement is completed.

To be specific, even when the centers of the engaging teeth 42 are offset from the centers of the depressions 33*b*, along with the insertion of the tooth 42 into the depressions 33*b*, the taper 42*a* contacts the protrusion 33*a* and the bezel 30 is slightly rotated within a rotational tolerance by a load on the protrusion 33*a* from the taper 42*a*, as shown in FIGS. 10B, 10C. Thereby, the offset between the engaging tooth 42 and the depression 33*b* is negated, facilitating the engagement of the engaging tooth 42 and the tooth 33 of the bezel 30. In FIGS. 10A, 10B, and 10C only one of the engaging teeth 42 is shown for the sake of better understanding of the action of the tapers 42*a*. In the present embodiment, the three engaging teeth 42 are actually engaged with the teeth 33.

Further, referring to FIG. 5, the restrictor 40 includes a tapered portion 41*a* on the engaging teeth 42 side of the top face 41 closer to the case 20. The tapered portion 41*a* is inclined downward as it approaches a face 48 facing the case 20. The tapered portion 41*a* is formed adjacent to above the shaft hole 45 into which the shaft 55 as a rotational center of the restrictor 40 is inserted. It works as a clearance to inhibit the top face of the restrictor 40 from contacting the bottom face 32 of the bezel 30 when the restrictor 40 is rotated about the shaft 55 as shown in FIGS. 7A and 7B.

According to the present embodiment, the three engaging teeth 42 are provided for the purpose of sufficiently secure the engaging force with the teeth 33 of the bezel 30. However, at least one engaging tooth 42 may be sufficient as long as a certain amount of the engaging force with the teeth 33 of the bezel 30 is secured by selecting the material and diameter of the engaging tooth 42. For instance, if the number of the teeth 33 of the bezel 30 is small and the interval therebetween is wide (e.g., the number of teeth is sixty (60)), the diameter of the engaging tooth 42 is correspondingly enlarged such that one engaging tooth 42 may be sufficiently strong and secure a sufficient engaging force. Note that in the present embodiment, the restrictor 40 is made from metal so that the engaging teeth 42 have high rigidity. The engaging force with the teeth 33 of the bezel 30 is sufficiently strong by a synergetic effect of the three engaging teeth 42.

The holding mechanism 50 functions to switch the restrictor 40 between a held state and a non-held state. In the held state the restrictor 40 is in the restricted position P1 while in the non-held state the restrictor 40 is movable to the release position P2. The holding mechanism 50 includes a pair of the legs 51*a*, 51*b*, which are similar to the lugs 20*a* connected to the band 90, integrally formed with the case 20, two push-buttons (operation input units) 52, 52 respectively fixed to the legs 51*a*, 51*b*, a spring bar (elastic operation member) 53 inserted into a bar hole 46 extending in parallel to the shaft hole 45 of the restrictor 40, and two pressers 54, 54 (restriction-release biasing member) including springs to bias the restrictor 40 to the release position P2 with an elastic force.

Figure 11A:
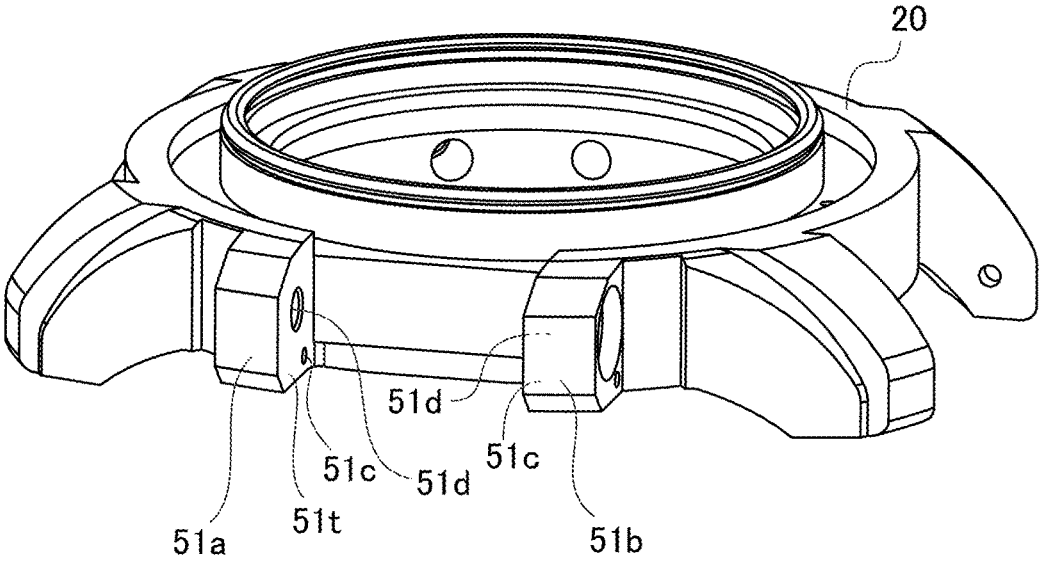
FIG. 11A is an overall perspective view of legs of a holding mechanism.
Figure 11B:
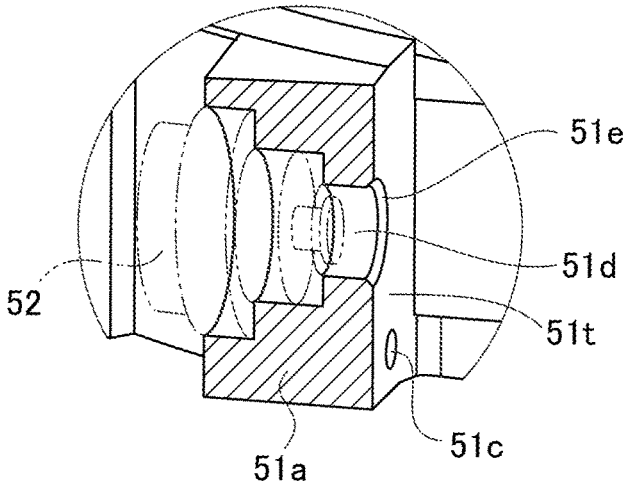
FIG. 11B is a cross section view of a detailed engaging hole of one leg of a holding mechanism.

The two legs 51*a*, 51*b* are arranged to place the restrictor 40 in-between them in the direction connecting 12 o'clock and 6 o'clock on the clock face. The two legs 51, 51*b* respectively include the holes 51*c*, 51*c* on faces 51*t*, 51*t* opposite to each other (hereinafter, opposing faces 51*t*, 51*t*) for supporting the ends of the shaft 55, as shown in FIGS. 11A, 11B. The ends of the shaft 55 each protruded from the end faces 47, 47 of the restrictor 40 are supported in the corresponding holes 51*c*. Thereby, the restrictor 40 is rotatably supported about the shaft 55, as shown in FIGS. 6A, 6B, 7A, and 7B. Note that the legs 51*a*, 51*b* each may be separately formed from the case 20 and then secured in the case 20 with screws. Further, each of the legs 51*a*, 51*b* may be a part of the case 20 instead of a part of the holding mechanism 50.

Figure 12:
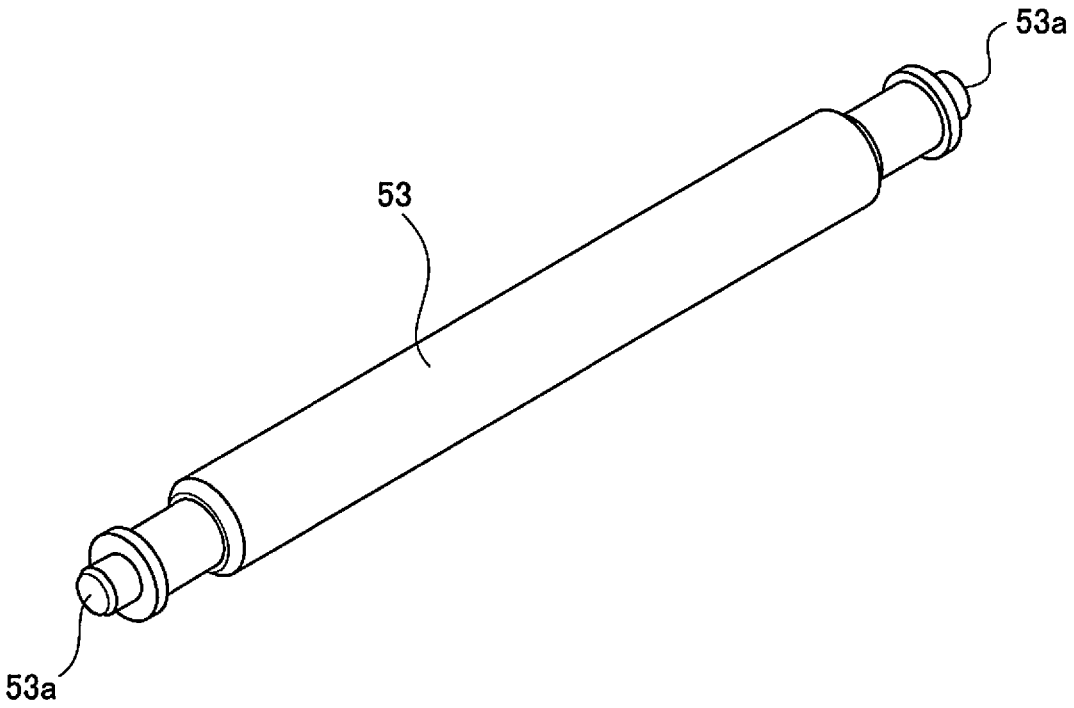
FIG. 12 is a perspective view of a spring bar.
Figure 20:
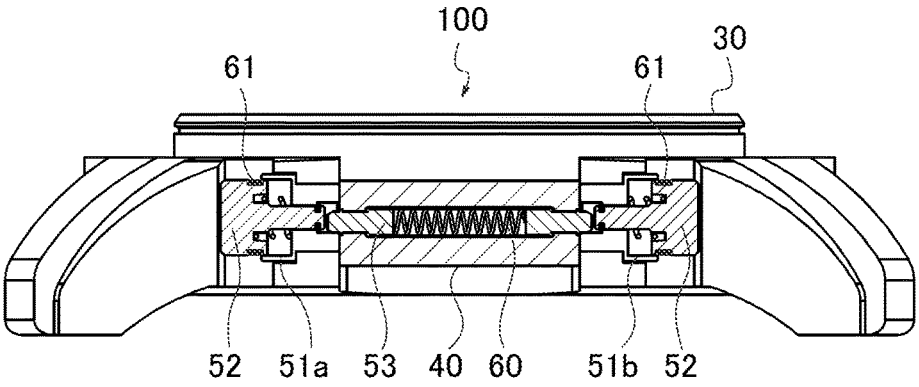
FIG. 20 is a cross section view of FIG. 19 along a D to D line.

As shown in FIG. 12, the spring bar 53 inserted into the bar hole 46 of the restrictor 40 is similar to the spring bar used for connecting the band 90 to the lugs 20*a*. It has a columnar body containing a spring 60 (FIG. 20). A pair of end portions 53*a*, 53*a* are protruded from the corresponding ends of the columnar body, biased outward of the columnar body by an elastic force of the spring 60 such that the spring 60 is extended, and be axially movable. Here, each end of the columnar body is narrowed in inner diameter to avoid the corresponding end portion 53*a*, 53*a* from dropping off from the body. The spring bar 53 is inserted into the bar hole 46 of the restrictor 40 with the end portions 53*a*, 53*a* partially protruded from both ends of the restrictor 40.

Figure 13:
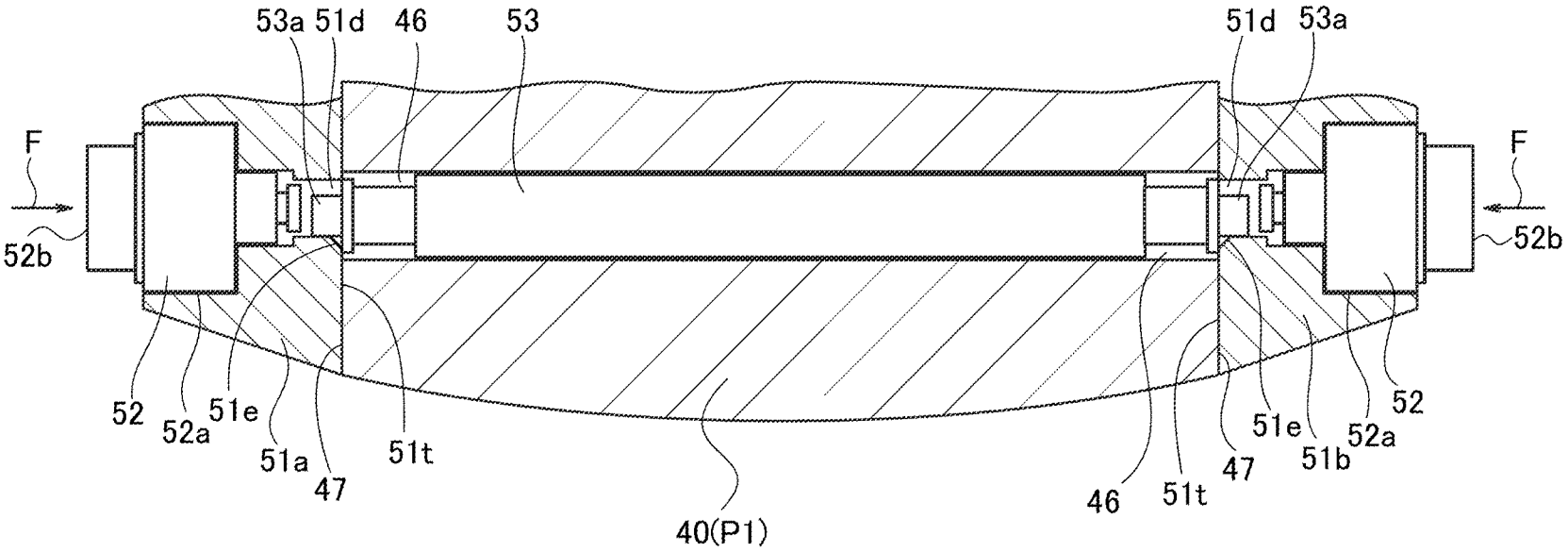
FIG. 13 is a cross section view of the spring bar and the restrictor, showing that an end of the spring bar is inserted into the engaging hole to place the restrictor in a held state.

As shown in FIGS. 11A, 11B, 13, the legs 51*a*, 51*b* of the holding mechanism 50 each includes an engaging hole 51*d*, 51*d* on an extension line from the bar hole 46 of the restrictor 40 in the restricted position P1. The end portions 53*a*, 53*a* protruded from both end faces 47, 47 of the restrictor 40 are fitted into the engaging holes 51*d*, 51*d*. Therefore, when the restrictor 40 is in the restricted position P1, the end portions 53*a*, 53*a* of the spring bar 53 inserting through the restrictor 40 are fitted into the corresponding engaging holes 51*d*, 51*d*. Thereby, the restrictor 40 is held in the restricted position P1.

The restrictor 40 is in the held state when it is in the restricted position P1. As shown in FIGS. 11A, 11B, 13, and 14, tapers 51*e* are formed at the opening edges of the engaging holes 51*d* of the opposing faces 51*t*, 51*t* of the legs 51*a*, 51*b*.

Figure 14:
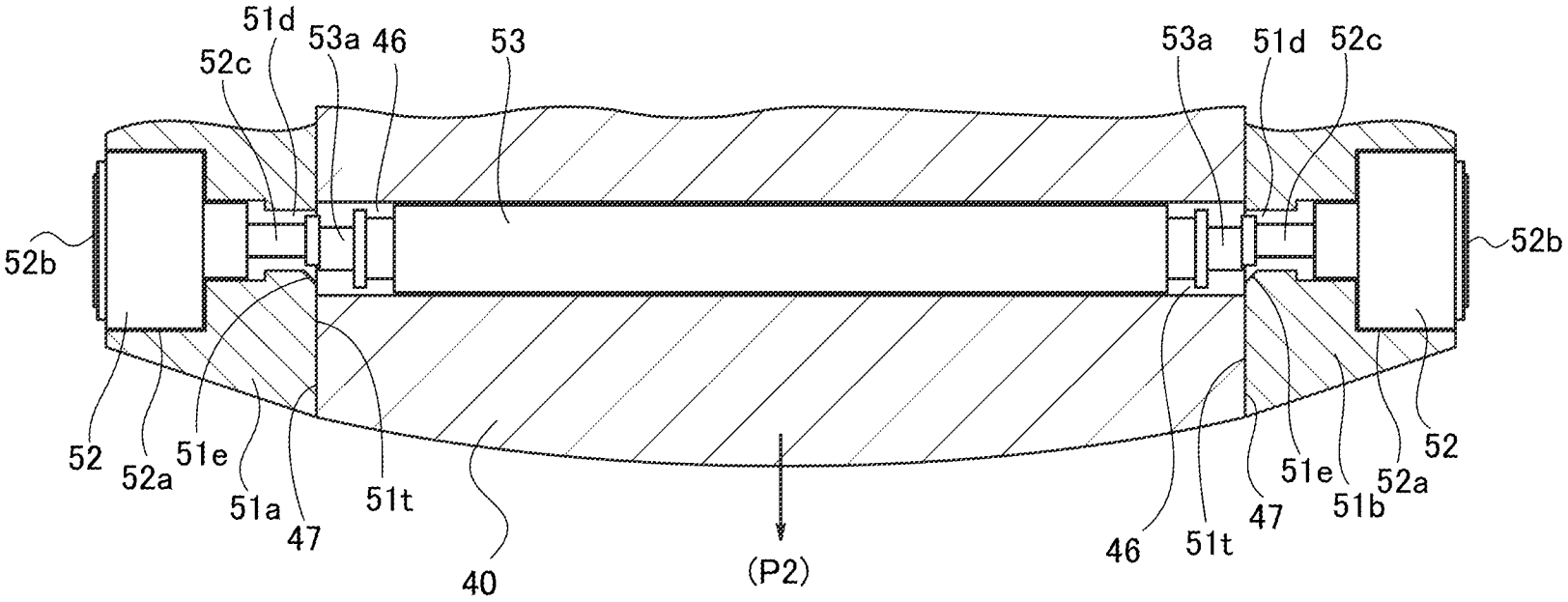
FIG. 14 is a cross section view of the spring bar and the restrictor, showing that the end of the spring bar comes out from the engaging hole to change the restrictor into a non-held state.

Further, the engaging holes 51*d*, 51*d* are stepped holes which become larger in diameter towards outside (leg 51*a* to 12 o'clock on the clock face, leg 51*b* to 6 o'clock) of the legs 51*a*, 51*b*. The push-buttons 52, 52 are attached in the corresponding holes 51*d*, 51*d* from outside of the legs 51*a*, 51*b* (FIGS. 11B, 13, 14).

Figure 15:
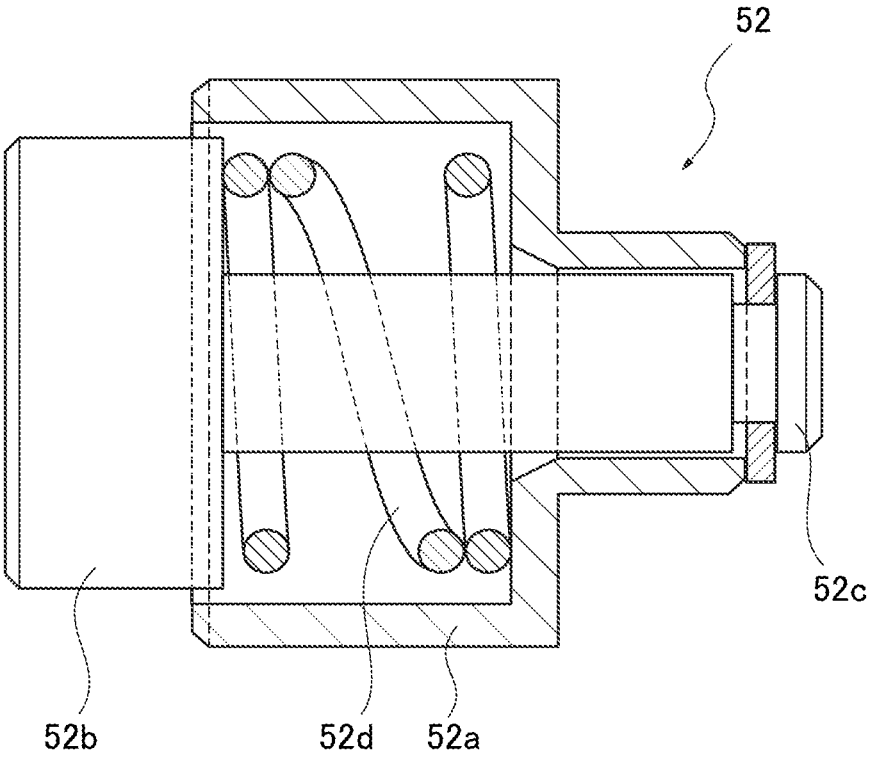
FIG. 15 is a cross section view of a detailed push-button.

As shown in FIG. 15, each of the push-buttons 52, 52 includes a case portion 52*a*, a button portion 52*b* and a pressing portion 52*c* integrally movable relative to the case portion 52*a*, and a spring 52*d* to bias the button portion 52*b* and the pressing portion 52*c* in a position (shown in FIG. 15) where the button portion 52*b* is largely protruded from the case portion 52*a* in a movable range of the button portion 52*b* and the pressing portion 52*c*.

The case portion 52*a* of one of the push-buttons 52 is fixed to the leg 51*a* by adhering to the engaging hole 51*d* such that the button portion 52*b* is protruded toward the engaging hole 51*d* of the leg 51*a* on the 12 o'clock side on the clock face. Similarly, the case portion 52*a* of the other push-button 52 is fixed to the leg 51*b* by adhering to the engaging hole 51*d* such that the button portion 52*b* is protruded toward the hole 51*d* of the leg 51*b* on the 6 o'clock side of the clock face.

How to secure the push-buttons 52, 52 in the engaging holes 51*d*, 51*d* should not be limited to the above fixing by adhesion. Alternatively, they may be fixed in various manners such as pressing and with screws.

The button portions 52*b*, 52*b* of the push-buttons 52, 52 secured in the engaging holes 51*d*, 51*d* protruded outward from the respective legs 51*a*, 51*b* (button portion 52*b* of the push-button 52 on the leg 51*a* protrudes toward 12 o'clock, and button portion 52*b* of the push-button 52 on the leg 51*b* protrudes toward 6 o'clock on the clock face). However, the button portions 52*b*, 52*b* are placed more inside the case 20 than both 12 o'clock and 6 o'clock side ends (ends of the lugs 20*a* coupled with the band (FIG. 1)) of the timepiece 100 at positions on a straight line connecting 12 o'clock and 6 o'clock thereof. That is, they are formed not to protrude to outside the case 20.

With each of the case portions 52*a* secured in the engaging hole 51*d*, the button portions 52*b* protruding to outside of the legs 51*a*, 51*b* are movable in an input direction of a pressing operation force F by inputting the pressing operation force F to the restrictor 40 (button portion 52*b* of the push-button 52 fixed to the leg 51*a* to 6 o'clock and the button portion 52*b* of the push-button 52 fixed to the leg 51*b* to 12 o'clock on the clock face, respectively).

When the button portions 52*b* are moved in the input direction of the pressing operation force F, the pressing portion 52*c* presses the end portion 53*a* of the spring bar 53 fitted in the engaging hole 51*d* in an axial direction. Receiving the pressing force F from the pressing portion 52*c*, the end portion 53*a* moves to the body side against the elastic force of the spring inside the spring bar 53. Then, it is extracted from the hole 51*d* as shown in FIG. 14. When the two end portions 53*a*, 53*a* of the spring bar 53 are simultaneously extracted from the holes 51*d*, 51*d*, the restrictor 40 becomes rotatable about the shaft 55 and movable from the restricted position P1 to the release position P2.

The spring bar 53 and the engaging holes 51*d*, 51*d* form a release mechanism for switching the restrictor 40 from the held state to the non-held state. The restrictor 40 is placed in the non-held state when it becomes rotatable from the restricted position P1.

The pressers 54 each include a spring and extend and shrink by the elastic force of the spring. They are accommodated in the holes 49, 49 in the face 48 opposing to the case 20 of the restrictor 40, as shown in FIG. 5. A part of the pressers 54 accommodated in the holes 49, 49 of the restrictor 40 protrudes from the face 48 to face the case 20 when the restrictor 40 is in the restricted position P1. Therefore, the pressers are shrunk by the spring's elastic force as shown in FIG. 6A. Accordingly, the pressers 54 apply an elastic force (pressing force) to the restrictor 40 to move to the release position P2 from the restricted position P1.

Next, acts of the timepiece 100 according to the present embodiment will be described. First, in initial state the restrictor 40 is located in the restricted position P1 shown in FIGS. 6A and 6B. The engaging teeth 42 of the restrictor 40 enter the depressions 33*b* of the bezel 30 and engage with the teeth 33 as shown in FIG. 10C, thereby preventing the bezel 30 from rotating. The pressers 54, 54 are shrunk to press the restrictor 40 to rotate to the release position P2. However, the end portions 53*a*, 53*a* of the spring bar 53 inserted through the bar hole 46 of the restrictor 40 are fitted into the corresponding ending holes 51*d*, 51*d* of the legs 51*a*, 51*b*, as shown in FIG. 13. Thereby, the restrictor 40 is retained in the restricted position P1.

By concurrently receiving opposing pressing operation forces F, F by a user's fingers as shown in FIGS. 6B and 13, for example, the button portions 52*b*, 52*b* of the two push-buttons 52, 52 are pressed and moved as shown in FIG. 14. Thereby, the pressing portions 52*c*, 52*c* integrated with the button portions 52*b*, 52*b* are also moved by the pressing operation forces F, F to press the corresponding end portions 53*a* of the spring bar 53 fitted in the engaging holes 51*d*, 51*d* of the legs 51*a*, 51*b*.

By the pressing operation forces F, F, the end portions 53*a*, 53*a* are extracted from the engaging holes 51*d*, 51*d* against the elastic force of the spring bar 53, as shown in FIG. 14. At the timing at which the end portions 53*a*, 53*a* are concurrently pushed out from the engaging holes 51*d*, 51*d*, the restrictor 40 is rotated about the shaft 55 by the pressing forces of the pressers 54, 54 and moved to the release position P2 shown in FIGS. 7A and 7B. Here, the end portions 53*a*, 53*a* are placed on the opposing faces 51*t*, 51*t* of the legs 51*a*, 51*b* and moved integrally with the restrictor 40 as contacting the opposing faces 51*t*, 51*t*.

When the restrictor 40 reaches the release position P2 from the restricted position P1, the engaging teeth 42 of the restrictor 40 are disengaged from the depressions 33*b* and the teeth 33 of the bezel 30. Thereby, the bezel 30 can rotate.

Even with no pressing operation forces F, F to the button portion 52*b*, 52*b* by the user's fingers, i.e., when removing the user's fingers from the button portions 52*b*, 52*b* of the push-buttons 52, 52, the restrictor 40 is rotated by the pressing force of the pressers 54, 54, and the end portions 53*a*, 53*a* are extracted from the engaging holes 51*d*, 51*d*. Therefore, the restrictor 40 remains in the release position P2, that is, in the non-held state. Thus, a user can operate the bezel 30 to rotate with the same fingers having removed from the push-buttons 52, 52 or a different finger.

In the release state shown in FIGS. 7A, 7B, the rotation restrictor 40*a* of the restrictor 40 contacts the rear face of the case 20. Thereby, the rotational range of the restrictor 40 is limited and the restrictor 40 stays in the rotational position shown in FIGS. 7A, 7B.

Thus, according to the timepiece 100 of the present embodiment, the restrictor 40 can be switched from the held state to the non-held state after the pressing operation forces F, F are concurrently applied to each of the push-buttons 52, 52 even if the pressing operation forces F, F are discontinued. With this, it becomes possible to separately perform an operation for releasing the bezel 30 from a rotation prevented state and an operation for rotating the bezel 30. Accordingly, both of the operations can be facilitated compared to a conventional operation in which the bezel 30 is rotated only while the operation for realeasing the bezel 30 from the rotation prevented state is being applied.

Further, according to the timepiece 100 of the present embodiment, the restrictor 40 can remain in the restricted position P1 as long as one of the end portions 53*a* is fitted into the engaging hole 51*d*. That is, the restrictor 40 cannot be switched to be in the non-held state unless the pressing operation forces F, F are concurrently applied to the two push-buttons 52, 52 so as to concurrently extract the both end portions 53*a*, 53*a* from the engaging holes 51*d*, 51*d*.

Thus, even when one of the button portions 52*b* receives the pressing operation force F by accidentally hit one of the push-buttons 52 to an obstacle or the like, the restrictor 40 can maintain the held state. That is, it is able to prevent or inhibit the restrictor 40 from being erroneously moved to the release position P2 by such an obstacle.

In addition, the push-buttons 52 pressed by the pressing operation force F are provided on the 9 o'clock side of the clock face, that is, located closer not to the palm but to the upper arm of a user who generally wears the timepiece 100 on the left wrist. It is considered that a user is unlikely to move his/her upper arm and hit an obstacle with the timepiece 100. Even if the obstacle touches the timepiece 100 by the user's motion, it hits the timepiece 100 from the palm side.

Accordingly, with the timepiece 100 having the push-buttons 52 on the upper arm side in the present embodiment, it is possible to further reduce the occurrence of an incident that the push-buttons 52 contact an obstacle and are pressed by the pressing operation force F irrespective of a user's intention.

Moreover, the two push-buttons 52, 52 are separately arranged below and above 9 o'clock position on the clock face, that is, the timepiece 100 is worn around the wrist along the width direction. It is very unlikely that the two positions on the timepiece 100 along the wrist width direction are hit with an obstacle at the same time. In view of this, it is also possible to further reduce the occurrence of an incident that the push-buttons 52 contact an obstacle and are pressed by the pressing operation force F irrespective of a user's intention.

When fixed in the engaging holes 51*d*, 51*d*, the button portions 52*b*, 52*b* of the push-buttons 52, 52 are formed not to protrude outward from the case 20 along the straight line connecting 12 o'clock and 6 o'clock on the clock face. By a user's arm motion along the line connecting 12 o'clock and 6 o'clock, the timepiece 100 probably touches an obstacle at an end of the case 20 on the 12 o'clock or 6 o'clock side. It is, therefore, able to reduce the possibility that the push-buttons 52 placed more inside the case 20 than the ends of the case close to 12 o'clock and 6 o'clock are hit by the obstacle.

The concurrent application of the pressing operation forces F, F to the push-buttons 52 signifies that periods where the pressing operation forces F, F are applied partially overlap with each other. It does not mean that the timings at which the applications of the pressing operation forces F, F are started or completed are concurrent.

Moreover, as shown in FIG. 1 the push-buttons 52, 52 are located by side faces 20*a*', 20*a*' of the lugs 20*a*, 20*a* provided on the 12 o'clock and 6 o'clock sides. The side faces 20*a*', 20*a*' of the lugs 20*a*, 20*a* extend in the direction in which the push-buttons 52, 52 are pressed.

Therefore, a user wearing the timepiece 100 about the left wrist touches the side faces 20*a*', 20*a*' of the lugs 20*a*, 20*a* (FIG. 1) with his/her right thumb and forefinger, aiming for pressing the push-buttons 52, 52 from both sides. The side faces 20*a*', 20*a*' of the lugs 20*a*, 20*a* function to guide the user's thumb and forefinger to the push-buttons 52, 52. This makes it easier for the user even wearing a diving glove on the dominant hand to surely press the push-buttons 52, 52 from both sides and release the restrictor 40 from the held state.

Alternatively, the push-buttons 52, 52 may be provided separately from the side faces 20*a*', 20*a*' of the lugs 20*a*, 20*a* and unused for guiding the fingers to the push-buttons 52, 52.

Further, as shown in FIGS. 5, 6A, 7A, outer corners 40*c* of a bottom face 40*b* of the restrictor 40 are obliquely cut off.

That is, the outer corners 40*c* of the restrictor 40 are not the right-angle but the oblique. With this, it can prevent the outer corners 40*c* of the bottom face 40*b* of the restrictor 40 from digging into or scratching the user's arm even if the user wearing the timepiece 100 on the wrist bends his/her wrist causing the outer corners 40*c* to touch the vicinity of the user's wrist, for instance.

In the timepiece 100 of the present embodiment, the end portions 53*a* of the spring bar 53 come off from the engaging hole 51*d* by the pressing operation force F applied to the push-buttons 52. Then, along with the motion of the restrictor 40 to the release position P2, the end portions 53*a* come rest on the opposing faces 51*t* of the legs 51*a*, 51*b*.

When only one of the push-buttons 52 receive the pressing operation force F and the corresponding end portion 53*a* of the spring bar 53 is extracted from the hole 51*d* (the other end portion 53*a* corresponding to the other one of the push-buttons 52 remains in the hole 51*d*), the spring bar 53 may be tilted in the bar hole 46 due to a clearance between the outer diameter of the spring bar 53 and the inner diameter of the bar hole 46. This may cause only one of the end portions 53*a* to remain rest on the opposing face 51*t*.

Then, when the other push-button 52 receives the pressing operation force F with the one push-button 52 after the pressing operation force F is removed from the push-button 52, the corresponding end portion 53*a* is also extracted from the engaging hole 51*d*. This may cause the restrictor 40 to be shifted in the non-held state from the held state even with no concurrent application of the pressing operation forces F to the both push-buttons 52, 52.

Figure 16:
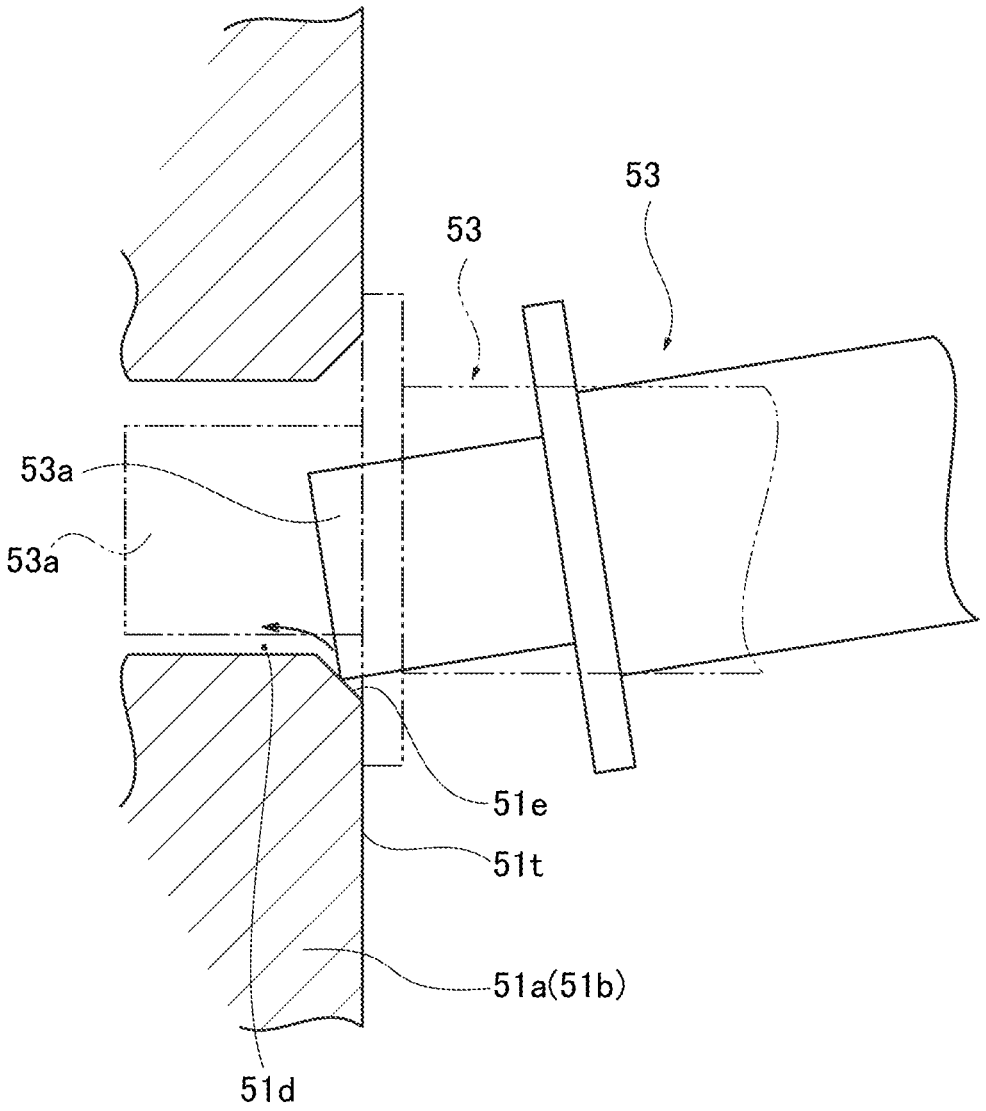
FIG. 16 is a cross section view of the essential part of a taper formed in the engaging hole.

In the timepiece 100 of the present embodiment, however, owing to the taper 51*e* at the opening edge of the engaging hole 51*d* of each of the legs 51*a*, 51*b* facing the restrictor 40 as shown in FIGS. 11A, 11B, 13, 14, the one end portion 53*a* hits the taper 51*e* so as to be prevented from resting on the opposing face 51*t* and returned to the engaging hole 51*d* along the inclined taper 51*e* even when the spring bar 53 is not aligned properly so that the one end portion 53*a* hits the opposing face 51*t*, as shown in FIG. 16.

Accordingly, it is able to securely prevent the restrictor 40 from being placed in the non-held state due to alternate application of the pressing operation forces F to the push-buttons 52.

For moving the restrictor 40 to the release position P2 so as to return the rotatable bezel 30 to be in the original rotation prevented state (the held state of the restrictor 40), the restrictor 40 is pressed (pressing operation force) against the elastic force of the pressers 54, 54 to the restricted position P1 from the release position P2 with a user's finger, for example. Thereby, the restrictor 40 is returned to the restricted position P1, and the engaging teeth 42 of the restrictor 40 are engaged with the teeth 33 of the bezel 30 to prevent the rotation of the bezel 30, as shown in FIG. 10C.

When the pressing operation force F for moving the restrictor 40 to the non-held state is removed from the push-buttons 52, 52, the pressing portions 52*c*, 52*c* of the push-buttons 52, 52 are returned by the elastic force of the spring 52*d* (FIG. 15) to be more inside the case 20 than the opposing faces 51*t*, 51*t* of the legs 51*a*, 51*b*. That is, when the restrictor 40 is returned to the restriction position P1, both of the end portions 53*a*, 53*a* of the spring bar 53 inserting through the bar hole 46 of the restrictor 40 are fitted into the engaging holes 51*d*, 51*d* of the legs 51*a*, 51*b*, and the restrictor 40 is held in the restricted position P1, as shown in FIG. 13.

According to the timepiece 100 of the present embodiment, when the restrictor 40 is in the restricted position P1, the outer circumference 44 of the restrictor 40 is smoothly connected to the outer circumferences 51*s*, 51*s* of the legs 51*a*, 51*b*, as shown in FIG. 6B. When the restrictor 40 is in the release position P2, the outer circumference 44 of the restrictor 40 protrudes more outward than the outer circumferences 51*s*, 51*s* of the legs 51*a*, 51*b*, as shown in FIG. 7B.

Thus, the outer circumference 44 of the restrictor 40 in the restricted position P1 does not project relative to the outer circumferences 51*s*, 51*s* of the legs 51*a*, 51*b* discontinuously. It is therefore possible to prevent the restrictor 40 or the legs 51*a*, 51*b* from being damaged due to an obstacle hooked by a discontinuous portion of the restrictor 40.

For returning the restrictor 40 to the restricted position P1 from the release position P2, since the outer circumference 44 of the restrictor 40 projects more outward than the outer circumferences 51*s*, 51*s* of the legs 51*a*, 51*b*, the projecting outer circumference 44 can be easily pressed to the restricted position P1 by a user's finger. The projecting outer circumference 44 also helps the user visually recognize the restrictor 40 in the release position P2 and prompts the user to return the restrictor 40 to the restricted position P1.

Figure 17A:
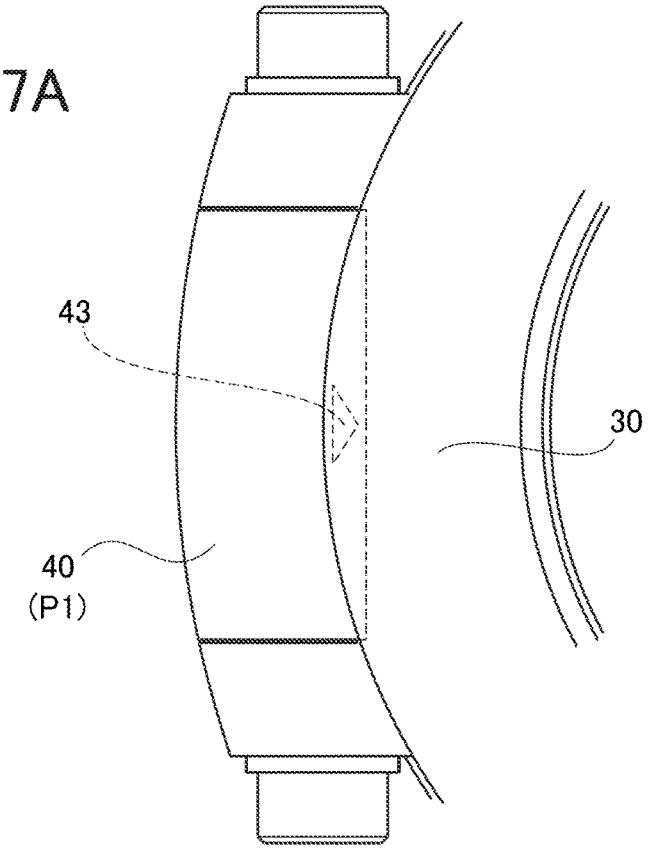
FIG. 17A is a view showing a mark indicating a release state when the restrictor cannot be viewed at the restricted position.
Figure 17B:
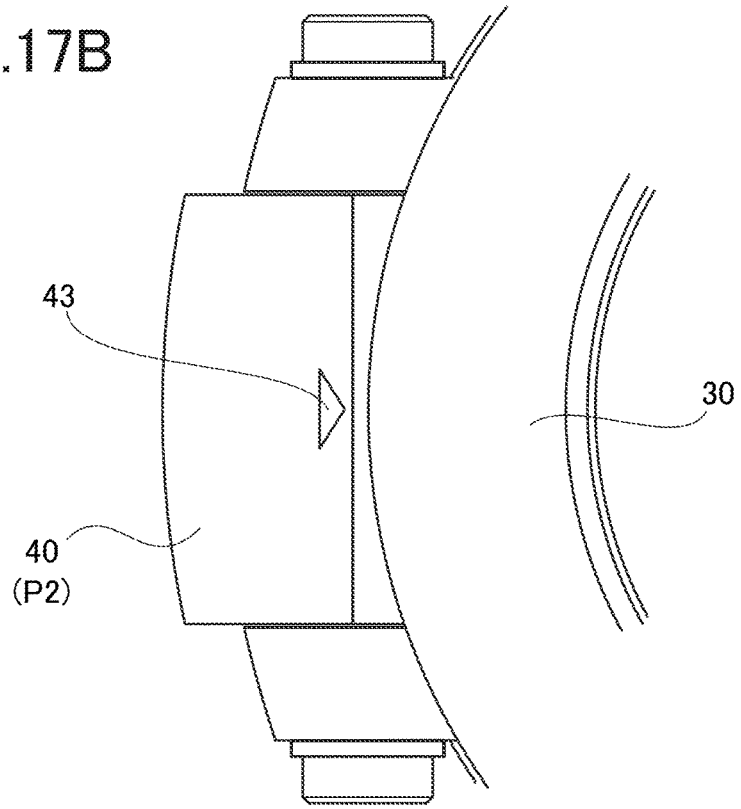
FIG. 17B is a view showing the mark indicating a release state when the restrictor can be viewed at the release position.

According to the timepiece 100 of the present embodiment the restrictor 40 includes a triangular mark 43 (release-state indicator shown in FIG. 5) on the top face 41. As shown in FIG. 17A, the mark 43 is below the bezel 30 and hidden by the bezel 30 in the restricted position P1, while as shown in FIG. 17B, the mark 43 is exposed outside the bezel 30 and viewable from outside in the release position P2. Because of this, a user can easily know that the restrictor 40 is in the release position P2 if the mark 43 is visible and in the restricted position P1 if the mark 43 is not visible even when the projecting outer circumference 44 of the restrictor 40 hinders the user from visually recognizing the restrictor 40 in the release position P2.

The shape of the mark 43 should not be limited to a triangular and can be another shape such as an arrow. Further, the mark 43 may be not entirely hidden but partially hidden (for example, the tip end to center of the triangular mark 43) by the bezel 30 in the restricted position P1 shown in FIG. 17A. In the release position P2 in FIG. 17B the part (the tip end to center of the triangular mark 43) of the mark 43 may appear to be viewable.

Moreover, according to the timepiece 100 of the present embodiment, the restrictor 40 is biased and moved to the release position P2 by pressers 54. To return the restrictor 40 to the restricted position P1 from the release position P2, it is necessary to apply the pressing force to the restrictor 40 against the elastic force of the pressers 54. Thereby, the restrictor 40 can be prevented from returning to the restricted position P1 by its own weight without an operator's intention.

Moreover, according to the timepiece 100 of the present embodiment, the pressers 54 are a part of the holding and releasing mechanism. However, the pressers 54 are not an essential element of the timepiece 100 since the restrictor 40 of a timepiece with no pressers 54 can be switched from the held state to the non-held state irrespective of the continuous application of the pressing operation force F to the push-buttons 52.

Further, the pressers 54 can be provided not on the restrictor 40 but on the case 20. However, in the case of a presser 54 is damaged or broken, the presser 54 on the restrictor 40 is preferable since the damaged or broken presser 54 together with the restrictor 40 can be easily replaced with a single replacement part, i.e., a new presser 54 having a restrictor 40 fixed thereon. Meanwhile, with the pressers 54 provided on the case 20, the pressers 54 need to be detached from the case 20 (have to be formed as detachable in the first place) or the entire case 20 needs to be replaced.

According to the timepiece 100 of the present embodiment, the directions of the pressing operation forces F, F applied to the push-buttons 52, 52 are orthogonal to the moving direction of the restrictor 40 between the restricted position P1 and the release position P2. Thereby, the restrictor 40 can be firmly held in the restricted position P1 when the pressing operation force F is not input.

Figure 18:
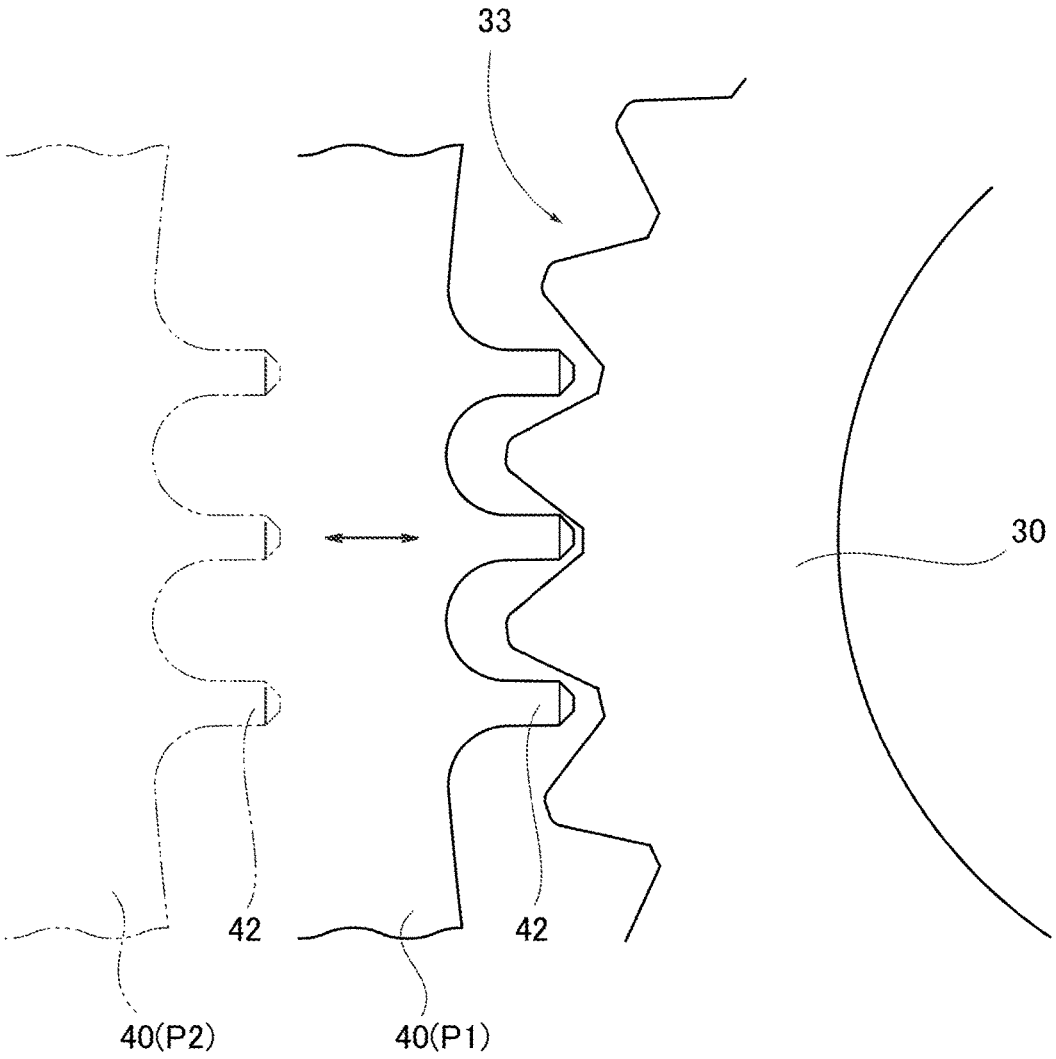
FIG. 18 is a view showing an example of the bezel including the teeth on an outer circumference of the bezel.

According to the timepiece 100 of the present embodiment, the bezel 30 includes the teeth 33 as an engaged portion on the bottom face 32 of the bezel 30. Alternatively, the engaged portion can be formed on the outer circumference of the bezel. That is, as shown in FIG. 18, the engaging teeth 42 of the restrictor 40 in the restricted position P1 are engaged with the teeth 33 on the outer circumference (does not have to be outermost circumference) of the bezel 30 to prevent the bezel 30 from rotating. The engaging teeth 42 of the restrictor 40 in the release position P2 are disengaged from the teeth 33 to allow the bezel 30 to rotate, for example.

Further, according to the timepiece 100 of the present embodiment, the existing teeth 33 of the bezel 30 are used as an engaged portion. The present invention should not be limited thereto. For instance, the engaged portion may be the teeth 33 on the bottom face 32 as in the present embodiment, or the same number of protrusions and depressions as that of the teeth 33 may additionally be provided on the outer circumference of the bezel 30 as the engaged portion with the restrictor 40.

According to the timepiece 100 of the present embodiment, the legs 51*a*, 51*b* are separately formed from the case 20 and fixed in the case 20 with screws, for example. This is effective in terms of facilitating the adjustment of the engaging teeth 42 of the restrictor 40 in the restricted position P1 and teeth 33 of the bezel 30.

According to the timepiece 100 of the present embodiment, the restrictor 40 is adapted to rotate between the restricted position P1 and the release position P2. However, the present invention should not be limited thereto. The restrictor 40 may be moved in parallel or may be moved in parallel and rotated.

Figure 19:
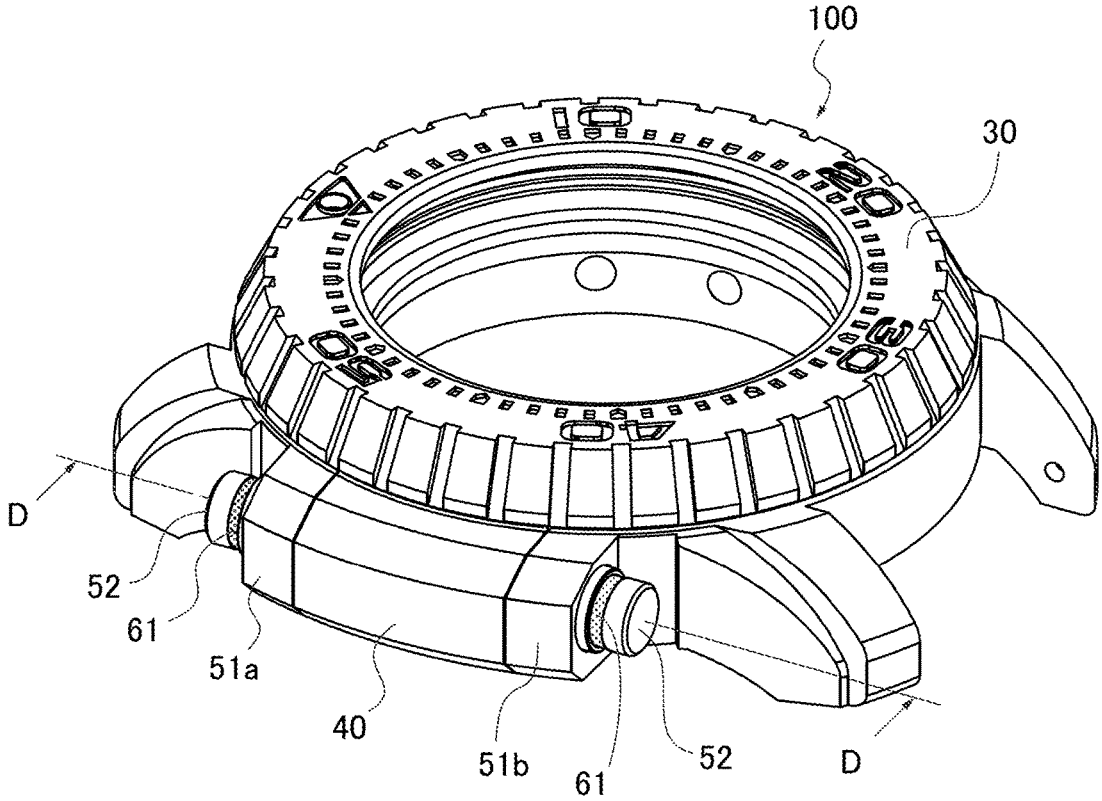
FIG. 19 is a perspective view of a ring-like unlock mark formed on an outer circumferences of two push-buttons.

Further, according to the timepiece 100 of the present embodiment ring-like unlock marks 61, 61 may be additionally formed on the outer circumferences of both the push-buttons 52, 52, as shown in FIGS. 19 and 20.

Figure 21:
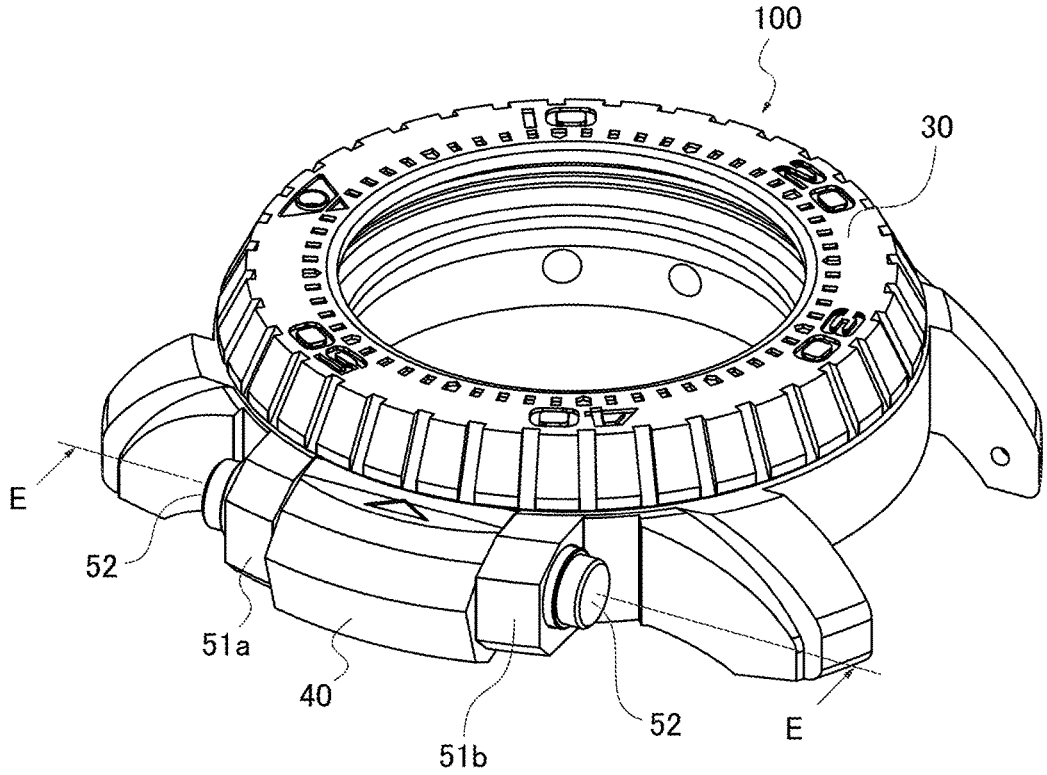
FIG. 21 is a perspective view of the two push-buttons pressed to the leg.
Figure 22:
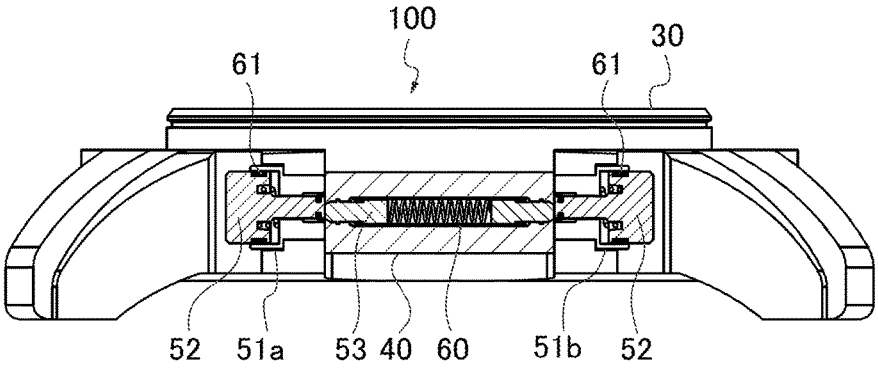
FIG. 22 is a cross section view of FIG. 20 along an E to E line.

As shown in FIGS. 19 and 20, the unlock marks 61, 61 are exposed to the outside of the legs 51*a*, 51*b* when the push-buttons 52, 52 are not pressed into the legs (i.e., when the restrictor 40 is in the held state). As shown in FIGS. 21 and 22, the unlock marks 61, 61 are hidden by the legs 51*a*, 51*b* when the push-buttons 52, 52 are pressed into a certain positions (i.e., the restrictor 40 is in the release state).

By forming the unlock marks 61, 61 on the outer circumferences of the push-buttons 52, 52, a user can easily know the disengagement of the restrictor 40 by pressing the push-buttons 52, 52 until the unlock marks 61, 61 are hidden. Preferably, the unlock marks 61, 61 should be formed in visible color such as red or yellow for the purpose of allowing the user to easily recognize the marks.

Figure 23A:
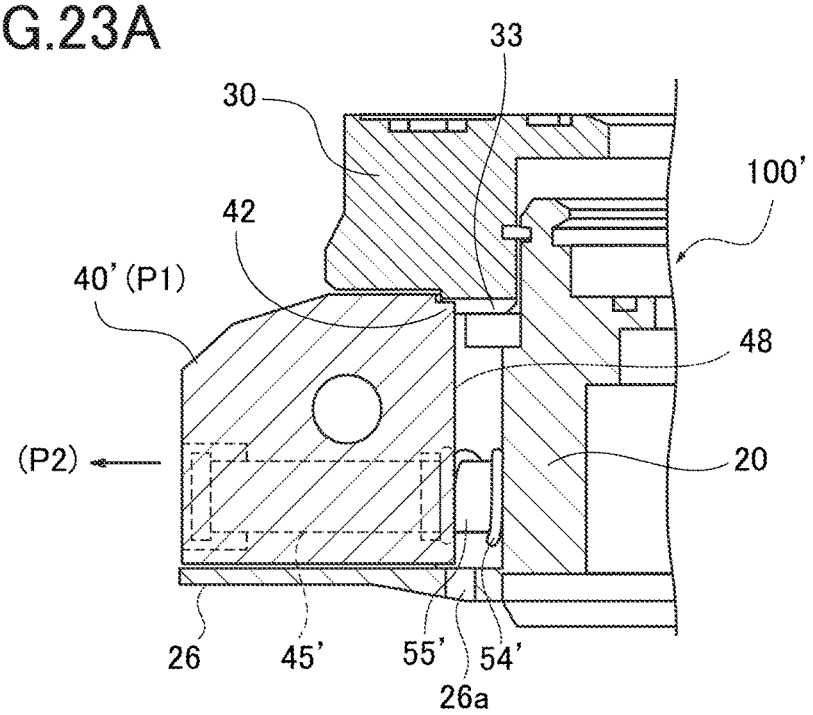
FIG. 23A is a cross section view of a restrictor moving (sliding) in parallel according to another embodiment when the center of a wristwatch and the restrictor are vertically sectioned and the restrictor is in a restricted position.
Figure 23B:
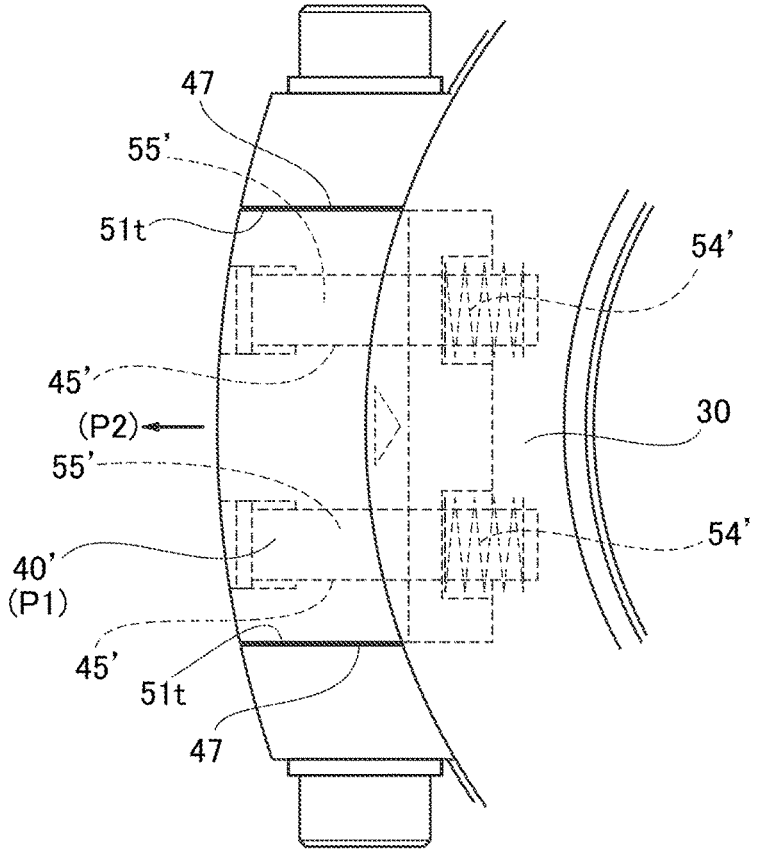
FIG. 23B is a plan view of the restrictor moving (sliding) in parallel according to another embodiment, showing that the restrictor is in the restricted position.
Figure 24A:
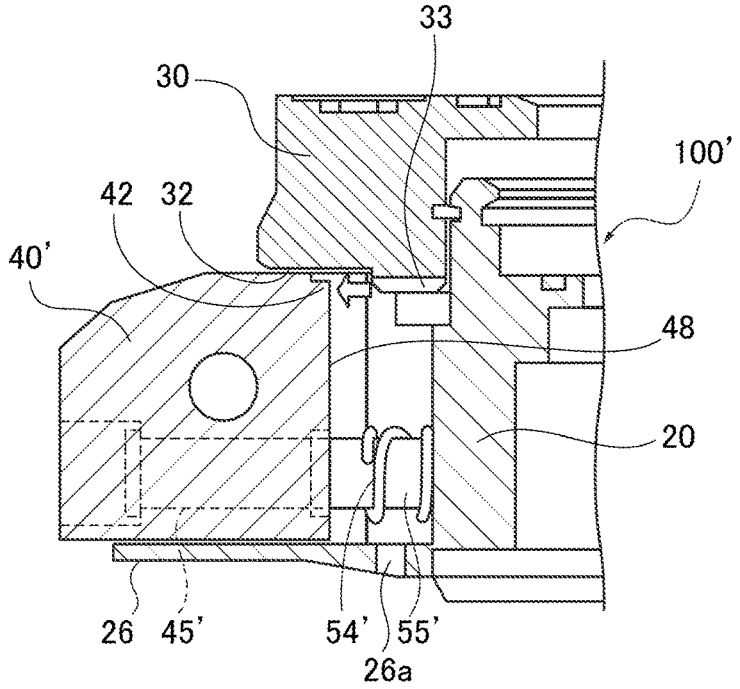
FIG. 24A is a cross section view of a restrictor moving (sliding) in parallel according to another embodiment when the center of a wristwatch and the restrictor are vertically sectioned and the restrictor is in a release position.
Figure 24B:
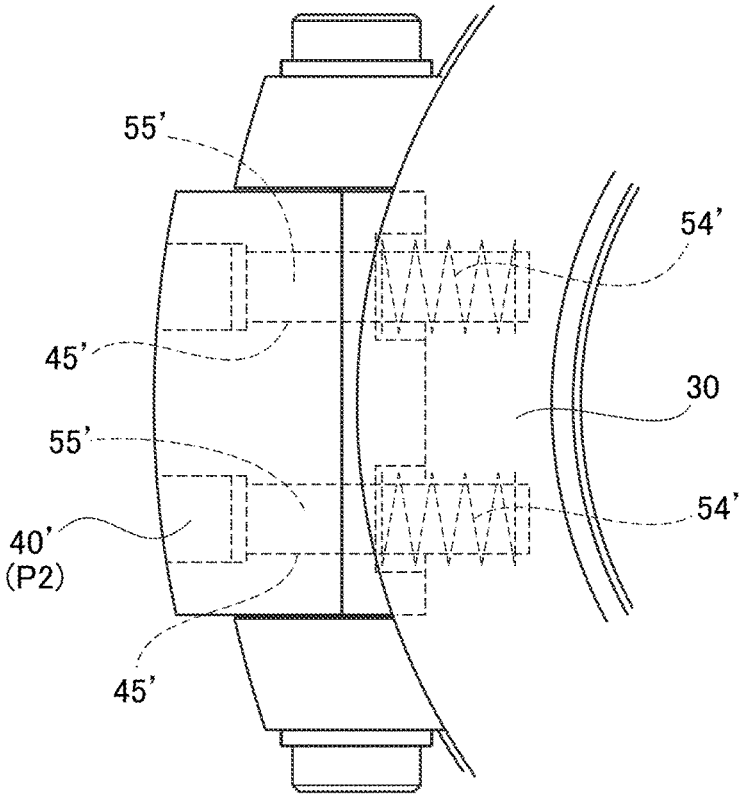
FIG. 24B is a plan view of the restrictor moving (sliding) in parallel according to another embodiment, showing that the restrictor is in the release position.

Another embodiment of the timepiece will be described with reference to FIGS. 23A, 23B, 24A, and 24B. In this embodiment, a restrictor 40' is configured to move in parallel between the restricted position P1 (FIG. 23A, 23B) and the release position P2 (FIGS. 24A, 24B). In a timepiece 100' according to this embodiment, the restrictor 40' is configured to move in parallel along two guide bars 55', 55' between the restricted position P1 and the release position P2 by being supported by the case 20 instead of the shaft 55 shown in FIG. 2.

The two guide bars 55', 55' are arranged in parallel to each other and inserted into guide holes 45', 45' of the restrictor 40' from the outer circumference 44 to the case 20. The restrictor 40' is secured in the case 20 by screwing male screws on the inserted ends of the guide bars 55', 55' with female screws on the case 20. In addition, springs 54' are disposed around the guide bars 55' in-between the case 20 and the restrictor 40'. Similar to the pressers 54 of the timepiece 100 in FIG. 2, the springs 54' function to apply pressing force to the restrictor 40' to move to the release position P2 from the restricted position P1. The other structures of the timepiece 100' except for the support for the restrictor 40' are the same as those of the timepiece 100 in FIG. 2 unless otherwise referred to.

In the timepiece 100' of this embodiment, the two end portions 53*a*, 53*a* are pressed out of the engaging holes 51*d*, 51*d* concurrently by the pressing operation forces F, F concurrently applied to the push-buttons 52, 52. The restrictor 40' is moved in parallel by the pressing force of the spring 54', 54' along the guide bars 55', 55' to the release position P2 shown in FIGS. 24A, 24B from the restricted position P1 shown in FIGS. 23A, 23B. When the restrictor 40' reaches the release position P2, the engaging teeth 42 of the restrictor 40' are separated from the depressions 33*b* of the bezel 30 and disengaged from the teeth 33. Thereby, the bezel 30 can rotate.

To return the rotatable bezel 30 to be in the original rotation prevented state, the restrictor 40' is pressed with a user's finger, for example, to the restricted position P1 from the release position against the elastic force of the springs 54', 54'. Thereby, the engaging teeth 42 of the restrictor 40' in the restricted position P1 are engaged with the teeth 33 of the bezel 30 to inhibit the bezel 30 from rotating, as shown in FIGS. 23A, 23B.

Accordingly, in the timepiece 100' according to the embodiment, it is possible to switch the restrictor 40' from the held state to the non-held state even when the pressing operation forces F, F are simultaneously applied to the two push-buttons 52, 52 but not continued. With this, it becomes possible to separately perform an operation for releasing the bezel 30 from a rotation prevented state and an operation for rotating the bezel 30. Accordingly, both of the operations can be facilitated compared to a conventional operation in which the bezel 30 is rotated only while the operation for realeasing the bezel 30 from the rotation prevented state is being applied.

Note that the timepiece 100' of this embodiment attains the same effects as those of the timepiece 100 in FIG. 2 in addition to the above. The acts of the timepiece 100' are the same as those of the timepiece 100, therefore, a description thereof is omitted.

Here, in the timepiece 100' of this embodiment, certain gaps need to be provided between the opposing faces 51*t*, 51*t* of the legs 51*a*, 51*b* and both ends 47, 47 of the restrictor 40' and between the surfaces of the guide bars 55', 55' and the guide holes 45', 45' in order to avoid friction between them and to smoothly move the restrictor 40' from the restricted position P1 to the release position P2. Note that too large gaps may cause the restrictor 40' to tilt and only one of the end portions 53*a* to be dropped off from the engaging hole 51*d*.

Meanwhile, in the timepiece 100 of FIG. 2 in which the restrictor 40 is rotated around the shaft 55, it is unlikely that only one of the end portions 53*a* is dropped off from the engaging hole 51*d* since the restrictor 40 is guided to rotate by the shaft 55 only and a gap between the shaft 55 and shaft hole 45 alone may cause the restrictor 40 to tilt.

Further, the timepiece 100' according to the embodiment shown in FIGS. 23A, 23B, 24A, and 24B includes a bottom plate 26 to supplementarily support the restrictor 40' from below. However, the bottom plate 26 is omissible since the restrictor 40' is supported by the guide bars 55', 55'.

Furthermore, the timepiece 100 in FIG. 1 is a diver's watch, therefore, often used on the sea or in seaside. If sand or the like is attached on the outer circumference or rear face of the bezel 30, the bezel 30 is cleaned with tap water from a faucet, for instance, to wash away the sand. However, sand entered in the small gaps between the face 48 of the restrictor 40 and the case 20 and between the bezel 30 and each tooth 33 cannot be easily washed away with tap water.

Figure 25:
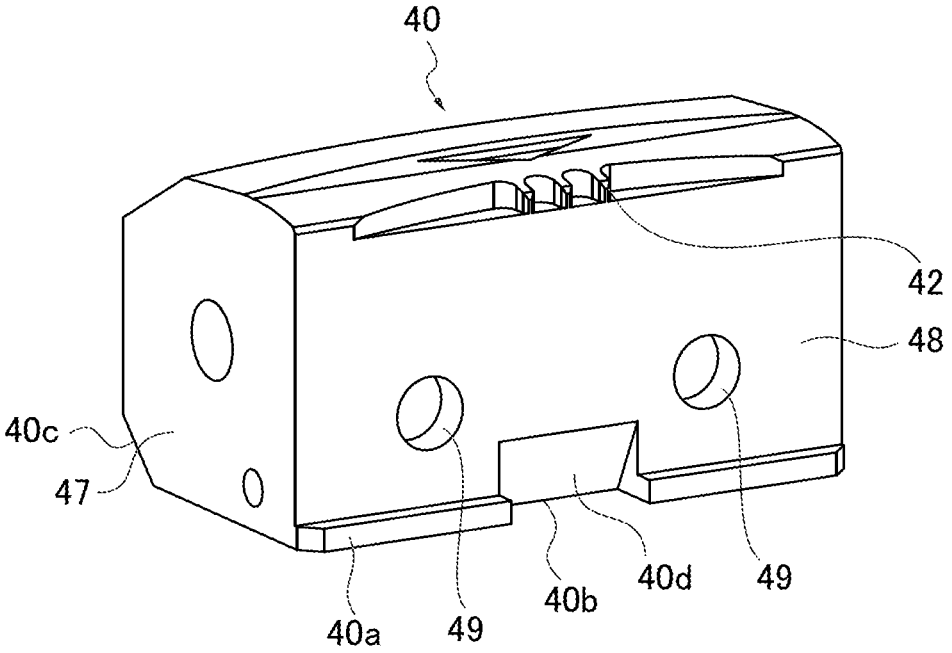
FIG. 25 is a perspective view of a cutout portion formed on the face of the restrictor closer to a case.
Figure 26:
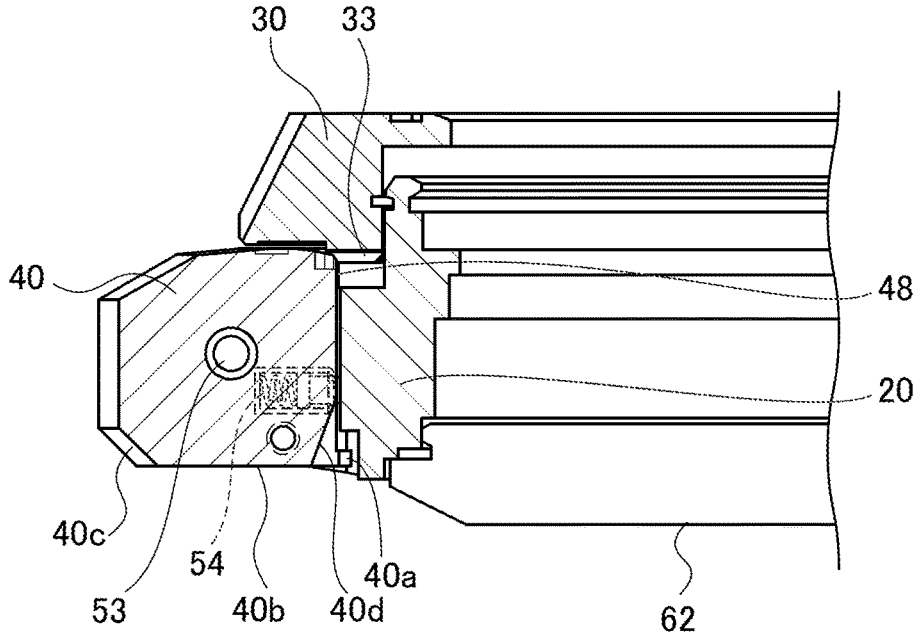
FIG. 26 is a cross section view of the restrictor in the restricted position.

In view of the above, in the timepiece 100, the face 48 of the restrictor 40 closer to the case 20 includes an inclined cutoff portion 40*d* of a certain width. The cutoff portion 40*d* is cut deeper from about the center to the bottom face 40*b*, as shown in FIGS. 25, 26. The cutoff portion 40*d* forms an opening through which water flows between the bottom face 40*b* of the face 48 of the restrictor 40 and the case 20.

The cutoff portion 40*d* is located between the two holes 49, 49 of the face 48 and the top of the cutoff portion 40*d* is located below the holes 49, 49. The shape and size of the cutoff portion 40*d* may be arbitrarily decided in addition to the ones shown in FIG. 27 as long as they do not hinder the rotational operation along with the release of the restrictor 40 from the held state.

Figure 27:
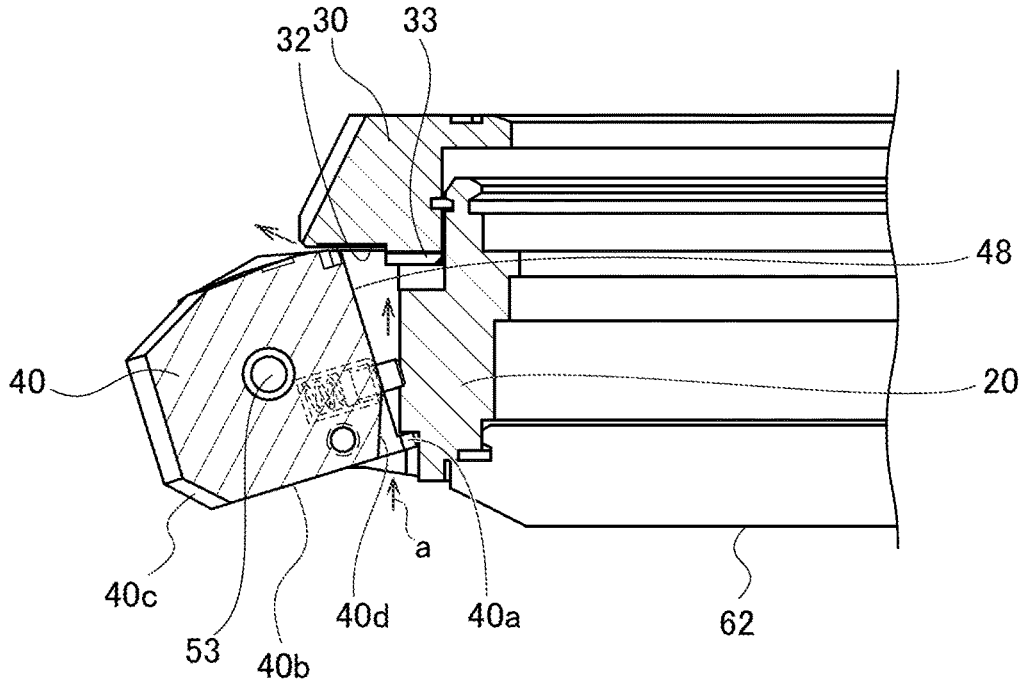
FIG. 27 is a cross section view of the restrictor in the release position.

For washing away sand from the gaps between the face 48 of the restrictor 40 and the case 20 and between the teeth 33 of the bezel 30 with tap water, the restrictor 40 is released from the held state and rotated, as shown in FIG. 27. The tap water flows from the opening of the bottom face 40*b* of the cutoff portion 40*d* (in the direction indicated by the arrow a in FIG. 27) through the gap between the face 48 of the restrictor 40 and the case 20, and is discharged from the gap between the bottom face 32 of the bezel 30 and the restrictor 40.

The tap water also flows into the gaps between the teeth 33 of the bezel 30 and is discharged together with the sand having entered the gaps between the face 48 of the restrictor 40 and the case 20 and between the teeth 33.

Alternatively, the tap water may flow from the bezel 30 side of the cutoff portion 40*d* in place of the bottom face 40*b* side. In this case, the tap water runs through the gap between the bottom face 32 of the bezel 30 and the restrictor 40 and the gap between the face 48 of the restrictor 40 and the case 20, and is then discharged from the opening of the cutoff portion 40*d* on the bottom face 40*b* side. The tap water also flows into the gaps between the teeth 33 of the bezel 30 and is discharged together with the sand having entered the gaps between the face 48 of the restrictor 40 and the case 20 and between the teeth 33.

Further, in the timepiece 100' as shown in FIGS. 23A and 24A in which the restrictor 40' is moved away from the case 20 when released from the held state, the bottom plate 26 as a supplementary support for the restrictor 40' may include a hole 26*a* through which water flows.

Also, in this case the tap water can flow into the gap between the face 48 of the restrictor 40' and the case 20 through the hole 26*a* or from the gap between the bottom face 32 of the bezel 30 and the restrictor 40, and be discharged through the hole 26*a*.

As shown in FIG. 26, the bottom face 40*b* of the restrictor 40 is located above the surface of a rear cover 62. Note that even when the restrictor 40 is released from the held state and rotated, the bottom face 40*b* of the restrictor 40 is located above the surface of the rearcover 62 as shown in FIG. 27.

Thus, a user wearing the timepiece 100 around the wrist can concurrently press the push-buttons 52, 52 and surely rotate the restrictor 40 to release the restrictor 40 from the held state without touching the bottom face 40*b* of the restrictor 40 since the rear cover 62 contacts the wrist but the bottom face 40*b* is separated from the wrist.

(Example of Separate Pipes)

Figure 28A:
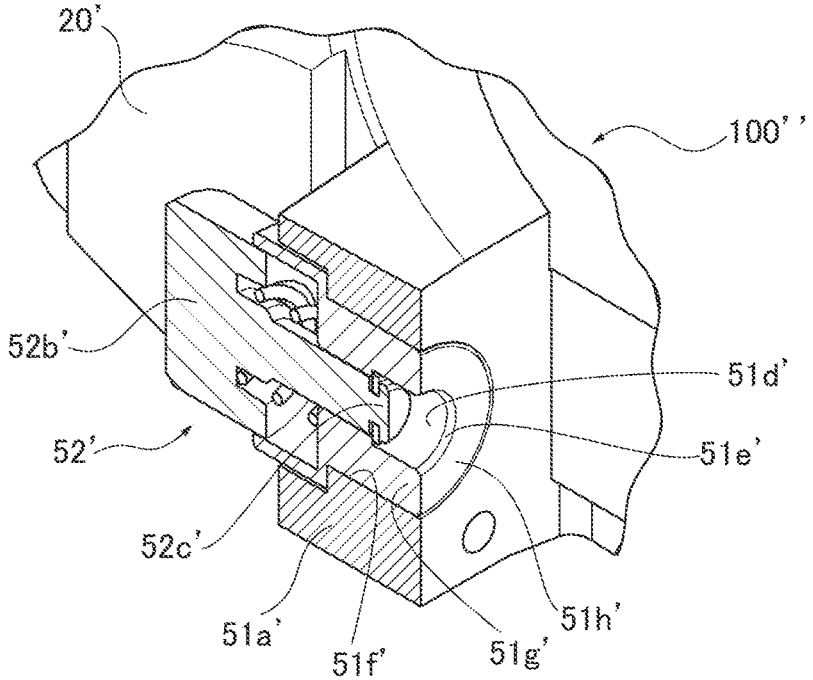
FIG. 28A is a horizontal cross section view of the example of the pipe including an engaging hole different from the leg.
Figure 28B:
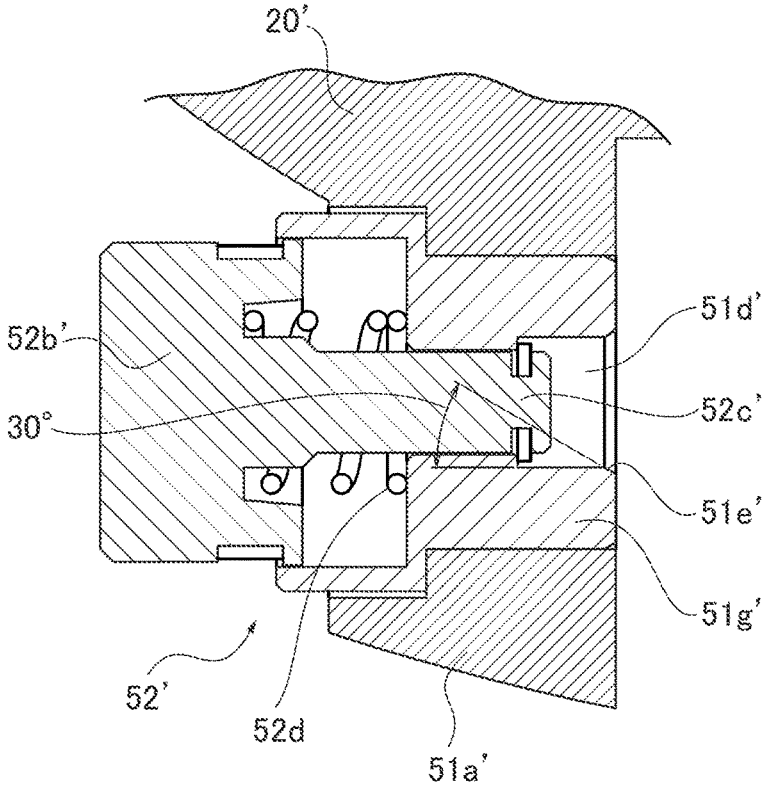
FIG. 28B is a vertical cross section view of another example of a pipe including an engaging hole different from the leg.

FIGS. 28A and 28B show another example of the present embodiment including pipes 51*g*', 51*g*' separated from legs 51*a*', 51*b*' and having engaging holes 51*d*', 51*d*'. In a timepiece 100" according to the example, the leg 51*a*' includes an insertion hole 51*f*' into which the pipe 51*g*' is inserted. Likewise, the leg 51*b*' includes an insertion hole 51*f*' into which the pipe 51*g*' is inserted although not shown. The pipes 51*g*' also function as the button case portion 52*a* as shown in FIG. 15. The pipes 51*g*' are attached to the legs 51*a*', 51*b*' after the button portions 52*b*' of the push-buttons 52' are attached to the pipes 51*g*'.

The pipes 51*g*', 51*g*' are made from a harder material (such as titanium alloy) than that of the legs 51*a*', 51*b*'. For instance, the material of the legs 51*a*', 51*b*' integrated with the case 20' is titanium while the material of the pipes 51*g*', 51*g*' is titanium alloy. Further, the pipes 51*g*', 51*g*' include the engaging holes 51*d*', 51*d*' and tapers 51*e*', 51*e*'.

Referring to the timepiece 100 in FIGS. 1 to 18, the spring bar 53 is placed between the legs 51*a*, 51*b*. Therefore, it is needed to form the tapers 51*e* on the opposing faces 51*t*, 51*t* of the legs 51*a*, 51*b*. A machining drill for forming the taper 51*e* on the leg 51*a* is longer than the distance between the opposing faces 51*t*, 51*t* of the legs 51*a*, 51*b*. That is, to form the taper 51*e*, only a tip end of the drill has to be applied to an intended portion of the opposing faces 51*t*, 51*t* from outside.

Therefore, the drill needs to be directed at the engaging hole 51*d* of the leg 51*a* from the 9 o'clock side of the leg 51*b* and inclined relative to the axis of the engaging hole 51*d*. In other words, the drill has to be inclined relative to the axis of the engaging hole 51*d* to machine the taper 51*e*. With use of a drill for precise machining which has to be placed orthogonally or in parallel to the axis of a target object, it may be difficult to precisely machine the taper 51*e*.

Meanwhile, in a timepiece 100" as shown in FIGS. 28A, 28B, the pipes 51*g*' separated from the leg 51*a*' include the engaging holes 51*d*' and the tapers 51*e*'. Accordingly, the tapers 51*e*' are formed on the pipes 51*g*' before fitted into the engaging holes 51*d*'. Thus, the tapers 51*e*' can be precisely machined by processing an intended portion with a cutting tool of an automatic lathe.

Moreover, the length between the opposing faces 51*t*, 51*t* of the legs 51*a*, 51*b* of the timepiece 100 is short. It is, therefore, difficult to polish the tapers 51*e*, 51*e* and the opposing faces 51*t*, 51*t*. Because of this, depending on a surface roughness of the tapers 51*e*, 51*e*, a large friction occurs when the end portions 53*a* of the spring bar 53 is moved while pressed by the surfaces of the tapers 51*e*, 51*e*. Only one of the end portions 53*a* of the spring bar 53 may be stuck on the taper 51*e* and stopped due to the friction when the pressing force F is applied to only one of the push-buttons 52, 52.

Meanwhile, in the timepiece 100" as shown in FIGS. 28A, 28B, the pipes 51*g*' including the engaging holes 51*d*', tapers 51*e*', and opposing faces 51*h*' can be processed with a cutting tool of an automatic lathe using a different member from the leg 51*a*'. Thus, the tapers 51*e*' and opposing faces 51*h*' can be formed to have smooth surfaces with a small surface roughness. Accordingly, it is able to prevent the end portions 53*a* of the spring bar 53 from stopping at the taper 51*e*' even if the pressing operation force F is applied to only one of the push-buttons 52, 52. Thereby, the end portions 53*a* can surely be returned to the original position.

Further, since the pipes 51*g*', 51*g*' are made from a material harder than that of legs 51*a*', 51*b*', it can avoid a problem that the surfaces of the tapers 51*e*' are depressed by the end portions 53*a* of the spring bar 53 or by the pressers 54 via the end portions 53*a* so as to affect the motion of the end portions 53*a* of the spring bar 53.

When the angle of the taper 51*e*' is set to about 30 degrees relative to the axis of the engaging hole 51*d*', the restrictor 40 can be smoothly moved from the restricted position P1 to the release position P2 by the opposite pressing operation forces F, F to the push-buttons 52', 52'. It is confirmed that by the pressing operation force F onto one of the push-buttons 52', 52', the end portion 53*a* of the spring bar 53 is temporarily moved to the taper 51*e*' but smoothly returned to the original position when released from the pressing force F.

Figure 29A:
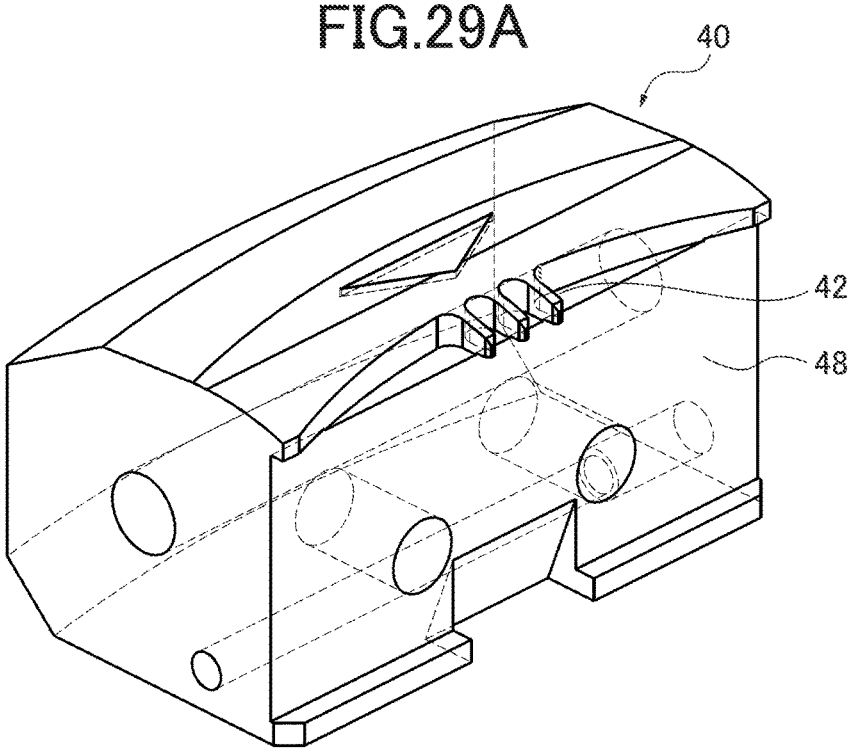
FIG. 29A is a perspective view of elongated engaging teeth of the restrictor by way of example.
Figure 29B:
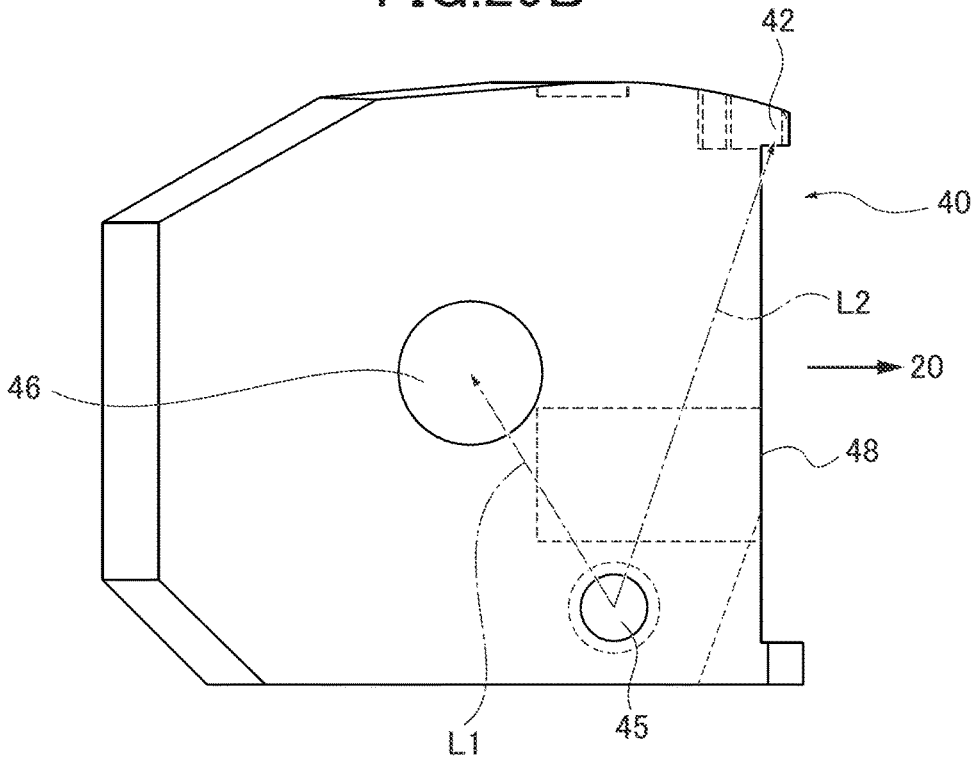
FIG. 29B is a side view of the elongated engaging teeth of the restrictor, as seen from a 6-o'clock side of the wristwatch.

In the timepieces 100, 100', 100" of the above embodiments, the engaging teeth 42 of the restrictor 40 may be formed to protrude toward the case 20 more than the face 48, as shown in FIGS. 29A, 29B. A distance L2 from the shaft hole 45 to the engaging teeth 42 is longer than a distance L1 from the shaft hole 45 to the bar hole 46. Accordingly, wobbles of the engaging teeth 42 relative to the teeth 33 of the bezel 30 is larger than those of the spring bar 53 relative to the engaging hole 46.

Owing to the engaging teeth 42 protruding toward the case 20 more than the face 48 as shown in FIGS. 29A, 29B, it becomes possible to suppress the wobbles of the engaging teeth 42 against the teeth 33 of the bezel 30, thereby surely preventing the engagement of the engaging teeth 42 and the teeth 33 of the bezel 30 from being unintentionally disengaged.

In the timepieces 100, 100', 100" of the above embodiments, the two push-buttons 52, 52 are arranged on the straight line, facing each other, to receive the pressing operation forces F, F in opposite directions. Therefore, it is easier to independently apply the pressing operation forces F, F to the push-buttons 52, 52 with a user's thumb and forefinger or thumb and middle finger, for example.

However, the arrangement of the two operation input units should not be limited to the above example. Alternatively, the pressing operation forces can be pressed in different directions from each other or in the same direction. That is, the timepiece according to the present invention should be provided with two or more operation input units into which the pressing operation forces are applied.

Figure 30:
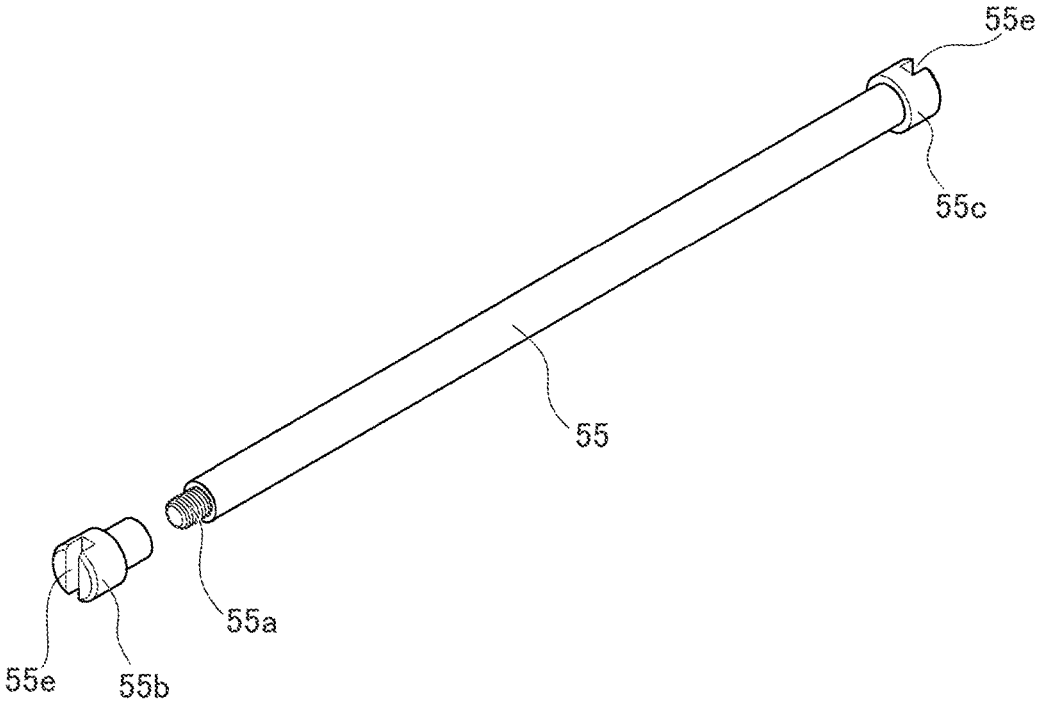
FIG. 30 is an exploded perspective view of another example of a shaft attached to the leg.

In the timepieces 100, 100', 100" of the above embodiments, the shaft 55 inserted into the legs 51*a*, 51*b* and the shaft hole 45 of the restrictor 40 can be fixed at an appropriate length position with screws in place of the sleeve 56. In this case, for example, the shaft 55 can include a male screw (or female screw) 55*a* at one end, as shown in FIG. 30. Then, the male screw (or female screw) 55*a* is engaged with a female screw (or male screw) 55*b* of a larger diameter than that of the male screw (or female screw) 55*a*.

The screw 55*b* includes, at a head, a groove 55*e* for a tool (such as a screw driver) to fasten the male screw (or female screw) 55*a* with the screw 55*b*. The shaft 55 further includes, at the other end, a head 55*c* in approximately the same thickness as that of the screw 55*b*. The head 55*c* also includes a groove 55*e* for a tool.

The 12 o'clock-side end of the shaft hole 51*c* of the leg 51*a* shown in FIGS. 11A, 11B has the diameter corresponding to the thickness of the screw 55*b* or head 55*c*. The rest of the shaft hole 51*c* of the leg 51*a* has the diameter corresponding to the rest of the shaft 55. Likewise, the 6 o'clock-side end of the shaft hole 51*c* of the leg 51*b* has the diameter corresponding to the thickness of the screw 55*b* or head 55*c*. The rest of the shaft hole 51*c* of the leg 51*b* has the diameter corresponding to the rest of the shaft 55.

The no-head end of the shaft 55 (the end forming the make screw or female screw) is inserted from the 12 o'clock or 6 o'clock-side end of the leg 51*a* or 51*b* into the shaft hole 51*c* of the leg 51*a*, and the shaft 55 is inserted to the shaft hole 45 of the restrictor 40 and the shaft hole 51*c* of the leg 51*b*. Then, the male screw (or female screw) 55*a* can be fastened with the screw 55*b* to attach the shaft 55 to the legs 51*a*, 51*b* with the appropriate length position.

In the timepieces 100, 100', 100" of the above embodiments, the spring bar 53 in the bar hole 46 of the restrictor 40 may be replaced with a similar member. For instance, the bar hole 46 can be formed as blind holes with depression portions in the vicinity of the legs 51*a*, 51*b* as show in in FIG. 13. The pressers 54, 54 shown in FIG. 2 may be mounted in the depression portions. In this case, the pressers 54 are placed with their ends moved by the inside spring set at the same position as the end portions 53*a* of the spring bar 53.

The ends of the pressers 54 are biased by springs inside the pressers 54 to be axially extended. Further, each end of the corresponding presser 54 is shrinkable as like the end portions 53*a* of the spring bar 53. Thus, the holding mechanism 50 or the release mechanism can be configured with a member as the pressers 54 other than the spring bar. However, the spring bar 53 is a single member including the pair of end portions 53*a*, 53*a*, therefore, it is preferable since an offset in the positions of the end portions 53*a*, 53*a* (especially in the rotational direction of the restrictor 40) is unlikely to occur. Also, the spring bar 53 can be easily handled or assembled.

In the timepiece 100, 100', 100" of the above embodiments, a release mechanism for automatically moving the restrictor 40 from the case 20 may be achieved by applying pressing operation force to the push-buttons 52 with no use of the pressers 54. For instance, in place of the pressers 54 of the timepiece 100, the ends of the push-buttons 52 shown in FIG. 13 may be tapered as seen from the end portion 53*a* of the spring bar 53.

In such a case, the taper surfaces of the push-buttons 52 are preferably shaped to press the end portion 53*a* of the spring bar 53 not only axially but also in the direction away from the case 20 upon receiving the pressing operation forces F.

In the timepiece of the present embodiment the bezel 30 is rotated counterclockwise by way of example, however, it should not be limited to such an example. Alternatively, the bezel 30 can be rotated both clockwise and counterclockwise. Further, the timepiece of the present embodiment is a diver's watch by way of example, however, it should not be limited to such an example. The present invention is applicable to any timepiece including a rotatable bezel.

The invention claimed is:

1. A timepiece comprising:

a case member containing a movement of a timepiece;

a bezel rotatably provided in the case member, including an engaged portion;

a restrictor including an engaging portion which prevents the bezel from rotating when engaged with the engaged portion and allows the bezel to rotate when disengaged from the engaged portion, the restrictor being movable between a restricted position in which the engaging portion is engaged with the engaged portion and a release position in which the engaging portion is disengaged from the engaged portion; and a holding mechanism which switchably holds the restrictor between a held state and a non-held state, the held state in which the restrictor is held in the restricted position, the non-held state in which the restrictor is moved to the release position, wherein the holding mechanism includes two operation input units to which independent pressing operation forces are respectively applied, and a release mechanism which moves the restrictor by moving a moving amount independent from a moving amount of the operation input units to switch the restrictor from the held state to the non-held state irrespective of a continuance of applying the pressing operation forces once the pressing operation forces are concurrently applied to the two operation input units.

2. The timepiece according to claim 1, wherein the restrictor is rotatable around a shaft, and the restrictor is moved between the restricted position and the release position by being rotated around the shaft.

3. The timepiece according to claim 1, wherein the release mechanism includes an elastic operation member containing an elastic member and having a pair of end portions biased by the elastic member to be axially extended, and an engaging members having engaging holes into which the pair of end portions are respectively fitted when the restrictor is held in the restricted position, and the two operation input units are respectively placed on extension lines of the end portions of the elastic operation member.

4. The timepiece according to claim 3, wherein each of the engaging members includes a taper on an edge of each of the engaging holes.

5. The timepiece according to claim 4, wherein the case includes a pair of legs, terminal ends of the elastic operation member are in direct contact with the pair of legs, and the engaging members are separately formed from the pair of legs and attached to the legs respectively.

6. The timepiece according to claim 3, wherein the restrictor is returned to the held state when the pair of end portions of the elastic operation member are respectively fitted into the engaging holes by receiving an operation force to move the restrictor from the release position to the restricted position.

7. The timepiece according to claim 1, wherein the release mechanism includes a restriction-release biasing member which biases the restrictor to the release position when the restrictor is held in the restricted position.

8. The timepiece according to claim 1, wherein the two operation input units are provided to receive the pressing operation force from a direction orthogonal to a moving direction of the restrictor.

9. The timepiece according to claim 1, wherein the engaged portion includes a plurality of protrusions and depressions formed along a circumference of a bottom surface of the bezel, and the restrictor includes at least one of convexes that engage with the depressions or concaves that engage with the protrusions.

10. The timepiece according to claim 1, wherein the restrictor includes a release-state indicator which is at least partially hidden from view when the restrictor is in the restricted position and is viewable when the restrictor is in the release position.

11. The timepiece according to claim 1, wherein the restrictor is placed in a position of the case member corresponding to 9 o'clock of the timepiece, the two operation input units are provided on a 9 o'clock side of the timepiece and are separately arranged below and above the 9 o'clock position on the timepiece, and the two operation input units are placed more inside the case member than a 12 o'clock-side end and a 6 o'clock-side end of the timepiece in plan view.

12. The timepiece according to claim 1, wherein the release mechanism moves the restrictor in a direction to apart from the operation input units.

* * * * *